US011827472B2

(12) United States Patent
Nakazawa

(10) Patent No.: US 11,827,472 B2
(45) Date of Patent: Nov. 28, 2023

(54) MEDIUM ALIGNING APPARATUS, MEDIUM PROCESSING APPARATUS, AND RECORDING SYSTEM

(71) Applicant: SEIKO EPSON CORPORATION, Tokyo (JP)

(72) Inventor: Atsushi Nakazawa, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 17/812,870

(22) Filed: Jul. 15, 2022

(65) Prior Publication Data

US 2022/0348429 A1 Nov. 3, 2022

Related U.S. Application Data

(63) Continuation of application No. 16/895,021, filed on Jun. 8, 2020, now Pat. No. 11,447,349.

(30) Foreign Application Priority Data

Jun. 11, 2019 (JP) ..... 2019-108948

(51) Int. Cl.
*B65H 31/02* (2006.01)
*B65H 31/36* (2006.01)
*B65H 1/04* (2006.01)

(52) U.S. Cl.
CPC ..... *B65H 1/04* (2013.01); *B65H 31/02* (2013.01); *B65H 31/36* (2013.01);
(Continued)

(58) Field of Classification Search
CPC ..... B65H 1/04; B65H 31/02; B65H 31/36; B65H 2301/44318; B65H 2801/06; B65H 2801/27; B65H 31/3027; B65H 2404/1114; B65H 31/3045; B65H 2301/4212; B65H 2301/4213; B65H 2301/44331;
(Continued)

(56) References Cited

U.S. PATENT DOCUMENTS 7,758,034 B1 * 7/2010 Namba ..... B65H 31/3009 270/58.07
9,994,408 B2 6/2018 Terao
2014/0103604 A1 * 4/2014 Saito ..... B65H 31/02 271/303

FOREIGN PATENT DOCUMENTS

JP 06-032443 * 4/1994 ..... B65H 31/30
JP H06-032443 4/1994
JP 2017-081665 A 5/2017

* cited by examiner

*Primary Examiner* — Yaovi M Ameh
(74) *Attorney, Agent, or Firm* — WORKMAN NYDEGGER

(57) ABSTRACT

A medium aligning apparatus includes a load tray including a load surface on which a medium discharged from a discharge member that discharges a medium is loaded, a first aligning surface that aligns a plurality of mediums loaded on the load tray by positioning rear ends of the mediums, and a second aligning surface that aligns the mediums by positioning the rear ends of the mediums loaded on the load tray. In the medium aligning apparatus, the first aligning surface and the second aligning surface are switchable, and an angle formed between a wall surface in the discharge tray that receives the mediums discharged from the load tray, the wall surface having the rear ends of the mediums come in contact therewith, and the second aligning surface is smaller than an angle formed between the wall surface and the first aligning surface.

9 Claims, 22 Drawing Sheets

(52) U.S. Cl.
CPC ..... *B65H 2301/44318* (2013.01); *B65H 2801/06* (2013.01); *B65H 2801/27* (2013.01)

(58) Field of Classification Search
CPC .. B65H 2405/11151; B65H 2405/1134; B65H 2405/1136
See application file for complete search history.

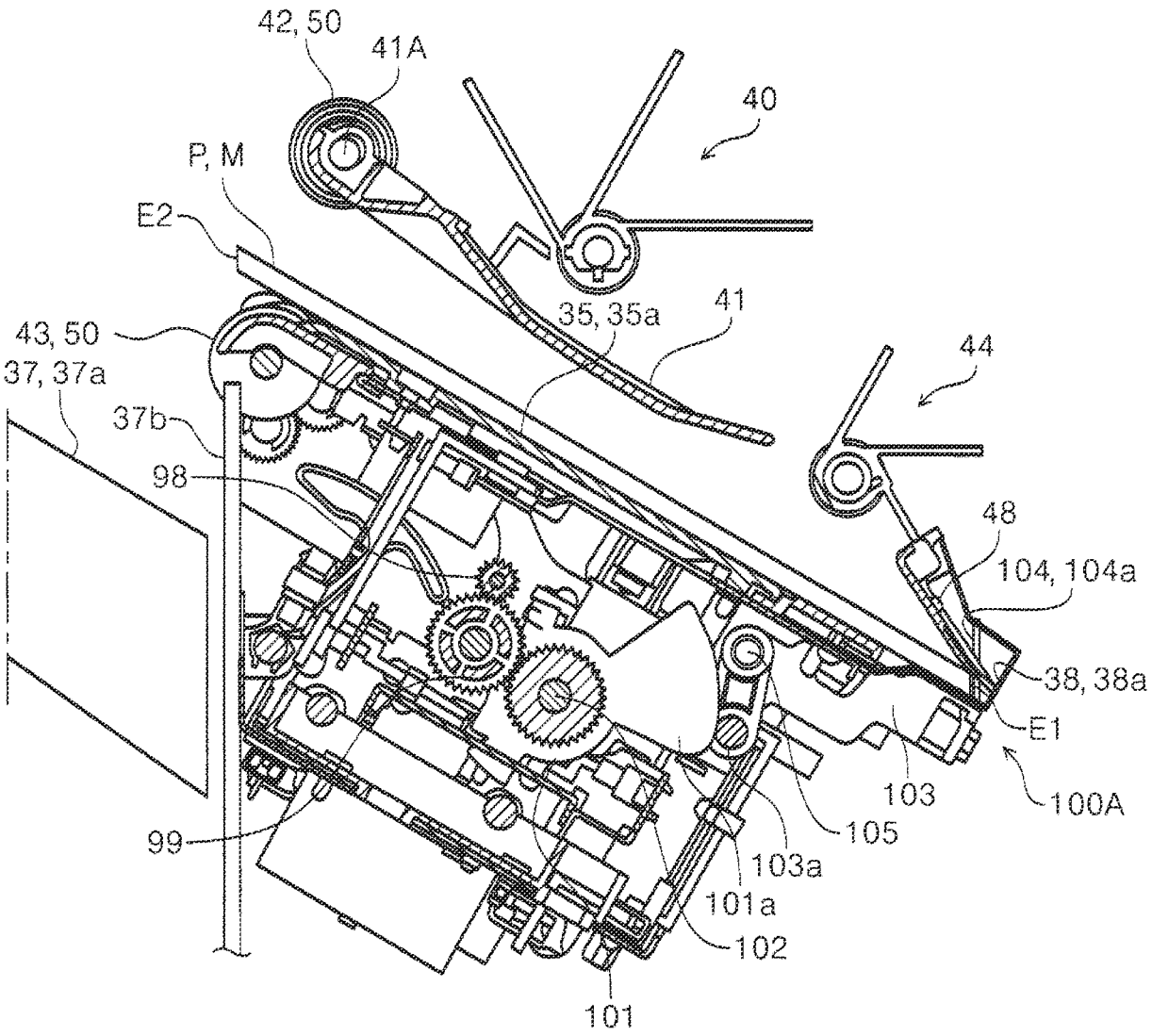
FIG. 5
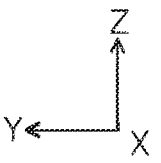

MEDIUM ALIGNING APPARATUS, MEDIUM PROCESSING APPARATUS, AND RECORDING SYSTEM

The present application is a Continuation of U.S. patent application Ser. No. 16/895,021, filed Jun. 8, 2020, which is based on, and claims priority from JP Application Serial Number 2019-108948, filed Jun. 11, 2019, the disclosures of which are hereby incorporated by reference herein in their entirety.

BACKGROUND

1. Technical Field

The present disclosure includes a medium aligning apparatus that aligns mediums, a medium processing apparatus that includes the medium aligning apparatus, and a recording system that includes the medium processing apparatus.

2. Related Art

In medium processing apparatuses that perform processes such as a stapling process and a punching process on mediums, there is a medium processing apparatus that is configured so that mediums are transported and stacked on a first tray, and so that the stack of mediums stacked on the first tray are discharged onto a second tray.

Note that such a medium processing apparatus is, in some cases, incorporated in a recording system that is capable of performing, in a sequential manner, recording on a medium with a recording apparatus, a representative example thereof being an ink jet printer, and post-processes such as a stapling process and the like on the medium on which recording has been performed.

For example, JP-A-2017-081665 discloses a postprocessing apparatus serving as a medium processing apparatus in which sheets loaded on a loading portion serving as a first tray are discharged onto an external tray serving as a second tray.

In a postprocessing apparatus described in JP-A-2017-081665, sheets loaded on a loading portion are transported to a pair of discharge rollers with a discharge claw, and are discharged onto the external tray with the pair of discharge rollers.

Referring hereinafter to FIG. 22, a technical issue of the known technique will be described. In FIG. 22, sheets P are aligned by being loaded on a load tray 35 and by having rear ends E1 be abutted against a first rear end aligning portion 38. The first rear end aligning portion 38 is a member corresponding to the discharge claw described in JP-A-2017-081665.

A stack of sheets P loaded on the load tray 35 is discharged in a discharge direction U while being nipped between a lower roller 43 and an upper roller 42, falls on the discharge tray 37, and is loaded thereon.

Note that typically, a direction in which the rear ends E1 are aligned using the first rear end aligning portion 38 is, in consideration of the stapling process with the staple, a direction perpendicular to a sheet load surface of the load tray 35 that forms an angle G against the wall surface 37*b* located at the base end side of the discharge tray 37. Accordingly, stacks of sheets M1, M2, M3, and M4 that have fallen on the discharge tray 37 are, as illustrated in the drawing, loaded in a stepwisely displaced manner on the discharge tray 37.

In the above case, if each stack of sheets is stapled with a staple, no problem will occur. However, when each stack of sheets are not intended to be sorted and are intended to be simply stacked on the discharge tray 37, and when the stacks of sheets are each loaded on the discharge tray 37 in a stepwise manner as described above, some users may align the stack of sheets by abutting the rear ends of the sheets against a flat surface such as that of a table after taking the stack of sheets out from the discharge tray 37. Accordingly, issues such as the above taking up the time of the user and the rear ends of the sheets being crushed may occur.

SUMMARY

A medium aligning apparatus that overcomes the above issues includes a load tray including a load surface on which a medium discharged from a discharge member that discharges a medium is loaded, a first aligning surface that aligns a plurality of mediums loaded on the load tray by positioning rear ends of the mediums, the rear ends being upstream ends of the mediums in a direction in which the mediums are discharged with the discharge member, and a second aligning surface that aligns the mediums by positioning the rear ends of the mediums loaded on the load tray. In the medium aligning apparatus, the first aligning surface and the second aligning surface are switchable, and an angle formed between a wall surface in the discharge tray that receives the mediums discharged from the load tray, the wall surface having the rear ends of the mediums come in contact therewith, and the second aligning surface is smaller than an angle formed between the wall surface and the first aligning surface.

BRIEF DESCRIPTION OF THE DRAWINGS

FIG. 5 is a side view of the medium aligning apparatus according to the first exemplary embodiment.

DESCRIPTION OF EXEMPLARY EMBODIMENTS

Figure 1:
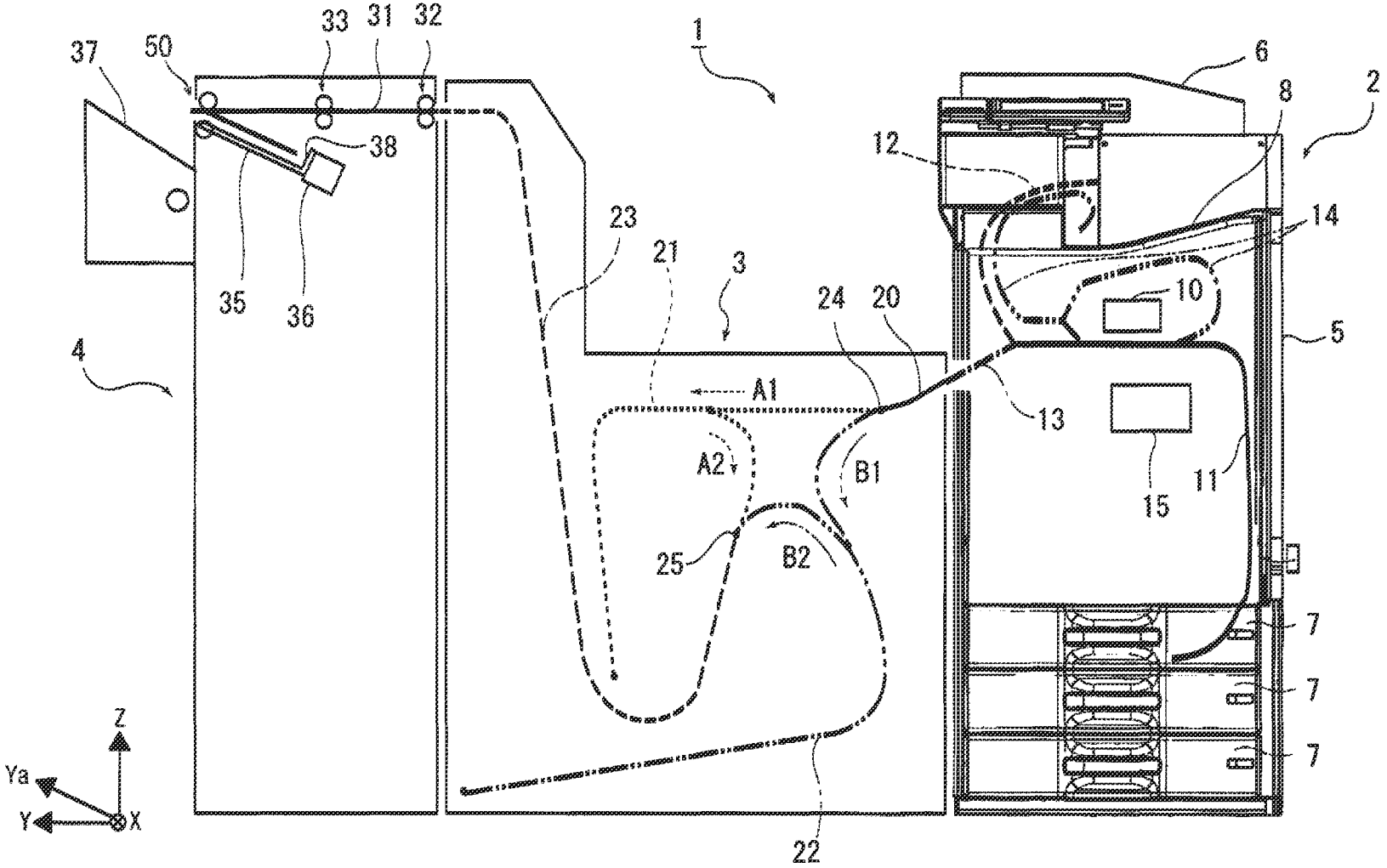
FIG. 1 is a schematic view of a recording system.

Hereinafter, the present disclosure will be described in a schematic manner.

A medium aligning apparatus according to a first aspect includes a discharge member that discharges a medium, a load tray including a load surface on which the medium discharged by the discharge member is loaded, a first aligning surface and a second aligning surface that align rear ends of a plurality of the mediums loaded on the load tray, a discharge tray on which the mediums discharged from the load tray are mounted, a wall surface that aligns the rear ends of the mediums on the discharge tray. In the medium aligning apparatus, the first aligning surface and the second aligning surface are switchable, and an angle formed between the wall surface and the second aligning surface is smaller than an angle formed between the wall surface and the first aligning surface.

According to the present aspect, the first aligning surface and the second aligning surface are switchable, and the angle formed between the wall surface in the discharge tray that receives the medium discharged from the load tray, the wall surface having the rear ends of the mediums come in contact thereto, and the second aligning surface is smaller than the angle formed between the wall surface and the first aligning surface; accordingly, by selecting the second aligning surface, the medium discharged on the discharge tray can be prevented from being loaded in a stepwisely displaced manner. As a result, the usability for the user is improved and damage can be suppressed from occurring at the rear ends of the mediums.

In a second aspect according to a first aspect, an angle formed between the load surface of the load tray and the first aligning surface is 90°, and an angle formed between the wall surface and the second aligning surface is 0°.

According to the present aspect, since the angle formed between the load surface of the load tray and the first aligning surface is 90°, by selecting the first aligning surface when a predetermined process is performed on the mediums loaded on the load tray, such as stapling with a staple, for example, an appropriate processing result can be obtained. Furthermore, since the angle formed between the wall surface and the second aligning surface is 0°, the mediums discharged on the discharge tray can be prevented more reliably from being displaced in a stepwise manner.

Note that the angle formed between the load surface of the load tray and the first aligning surface being 90° is not strictly limited to 90° and includes a certain degree of error caused by production tolerance or the like.
Similarly, the angle formed between the wall surface and the second aligning surface being 0° is not strictly limited to 0° and includes a certain degree of error caused by production tolerance or the like.

In a third aspect according to the first or second aspect, the load surface of the load tray and a support surface of the discharge tray that supports the medium are inclined upwards towards a downstream side in the discharge direction.

According to the present aspect, since the load surface of the load tray and the support surface of the discharge tray that supports the medium are inclined upwards towards a downstream side in the discharge direction, the rear ends of the mediums can be aligned appropriately in both the load tray and the discharge tray.

In a fourth aspect according to any one of the first to third aspects, when, at least, a process is not to be performed on the mediums loaded on the load tray, the rear ends of the mediums are aligned using the second aligning surface.

According to the present aspect, when, at least, the process is not to be performed on the mediums loaded on the load tray, the rear ends of the mediums are aligned with the second aligning surface; accordingly, when the process is not to be performed on the mediums loaded on the load tray, the mediums discharged onto the discharge tray can be prevented from being loaded in a stepwisely displaced manner and, consequently, usability for the user is improved and damage at the rear ends of the mediums can be prevented from occurring.

Note that the process herein denotes postprocessing such as stapling a plurality of mediums mounted on the load tray with a staple, and, at least, does not include the process of aligning the mediums loaded on the load tray with the first aligning surface or the second aligning surface.

In a fifth aspect according to any one of the first to fourth aspects, the first aligning surface and the second aligning surface are formed of different members.

According to the present aspect, since the first aligning surface and the second aligning surface are formed of different members, the degree of freedom of designing the angle formed between the first aligning surface and the load surface, and that of the angle formed between the second aligning surface and the wall surface are improved.

In a sixth aspect according to the fifth aspect, the second aligning surface is provided on a rotatable rotation member, and a first state in which the second aligning surface is advanced above the load tray and a second state in which the second aligning surface is retracted from above the load tray are switchable by rotation of the rotation member.

According to the present aspect, since the first state in which the second aligning surface is advanced above the load tray, and the second state in which the second aligning surface is retracted from above the load tray are switchable by rotation of the rotation member, the first aligning surface and the second aligning surface can be switched with a simple configuration.

In a seventh aspect according to any one of the first to fourth aspects, the first aligning surface and the second aligning surface are formed of the same member.

According to the present aspect, since the first aligning surface and the second aligning surface are formed of the same member, the cost of the apparatus can be reduced.

According to an eighth aspect according to the seventh aspect, the first aligning surface and the second aligning surface are provided on a rotatable rotation member, and a first state in which the rear ends of the mediums are aligned with the second aligning surface and a second state in which the rear ends of the mediums are aligned with the first aligning surface are switchable by rotation of the rotation member.

According to the present aspect, since the first aligning surface and the second aligning surface are provided on the rotatable rotation member, and the first state in which the rear ends of the mediums are aligned with the second aligning surface and the second state in which the rear ends of the mediums are aligned with the first aligning surface are switchable by rotation of the rotation member, switching between the first state and the second state can be performed with a simple configuration.

A ninth aspect includes a load tray on which a medium discharged by a discharge member that discharges a medium is loaded, and a rear end aligning surface that performs aligning of a plurality of the mediums loaded on the load tray by positioning rear ends of the mediums, the rear ends being upstream ends of the mediums in a direction in which the mediums are discharged with the discharge member. In the ninth aspect, a wall surface in the discharge tray that receives a medium discharged from the load tray, the wall surface having the rear ends of the mediums come in contact therewith, and the rear end aligning surface are parallel to each other.

According to the present aspect, since the wall surface in the discharge tray that receives a medium discharged from the load tray, the wall surface having the rear ends of the mediums come in contact therewith, and the rear end aligning surface are parallel to each other, the medium discharged on the discharge tray can be prevented from being loaded in a stepwisely displaced manner. As a result, the usability for the user is improved and damage can be suppressed from occurring at the rear ends of the mediums.

Note that the wall surface and the rear end aligning surface being parallel to each other is not limited to the wall surface and the rear end aligning surface being strictly parallel to each other and includes a certain degree of error caused by production tolerance or the like.

A medium processing apparatus according to a tenth aspect includes medium aligning apparatuses according to any one of the first to ninth aspects, in which the medium aligning apparatuses are disposed on both sides of a center position of the medium processing apparatus in a width direction that is a direction intersecting a discharge direction of a medium, and a processing portion that is, with respect to the load tray, positioned upstream in a direction in which the medium is discharged by the discharge member, the processing portion performing a process on the medium loaded on the load tray.

According to the present aspect, effects similar to those of the first to ninth aspects can be obtained in the medium processing apparatus.

A recording system according to an eleventh aspect includes a recording unit that includes a recording member that performs recording on a medium, and a medium processing apparatus according to the tenth aspect, in which the medium processing apparatus performs a process on a recorded medium recorded in the recording unit.

According to the present aspect, effects of the tenth aspect can be obtained in the recording system.

In a twelfth aspect according to the first aspect, the load surface of the load tray and a support surface of the discharge tray that supports a medium are parallel to each other.

Hereinafter, the present disclosure will be described in detail.

In the X-Y-Z coordinate system in each of the drawings, the X-axis direction is a width direction of a medium and is also an apparatus depth direction, the Y-axis direction is an apparatus width direction, and the Z-axis direction is an apparatus height direction and indicates the vertical direction.

Note that hereinafter, the medium is referred to as a medium P, an end portion of the medium P in the medium aligning apparatus described later in the −Y direction is referred to as a rear end E1 and, similarly, an end portion of the medium P in the +Y direction is referred to as a front end E2. An example of the medium P includes a recording sheet.

Note that in each of the drawings, the same component is attached with the same reference numeral, and in the plurality of exemplary embodiments described hereinafter, redundant description will be avoided.

A recording system 1 illustrated in FIG. 1 includes, from the right side towards the left side in FIG. 1, a recording unit 2, an intermediate unit 3, and a processing unit 4.

The recording unit 2 includes a line head 10 serving as a recording member that performs recording on the medium P. The intermediate unit 3 receives the medium P on which recording has been performed from the recording unit 2 and delivers the medium to the processing unit 4. The processing unit 4 includes a processing portion 36 that performs a predetermined process on the medium P mounted on a load tray 35. Note that the processing unit 4 that is an example of the medium processing apparatus includes the medium aligning apparatus, which will be described later separately.

In the recording system 1, the recording unit 2, the intermediate unit 3, and the processing unit 4 are coupled to each other; accordingly, the recording system 1 is configured to transport the medium P from the recording unit 2 to the processing unit 4.

The recording system 1 is configured so that inputs such as a recording operation, whether postprocessing is to be performed, and the like on the medium P in the recording unit 2, the intermediate unit 3, and the processing unit 4 can be made through an operation panel (not shown). The operation panel can be, as an example, provided in the recording unit 2.

Hereinafter, outlines of the configurations of the recording unit 2, the intermediate unit 3, and the processing unit 4 will be described in the above order.

The recording unit 2 illustrated in FIG. 1 is configured as a multifunction machine that includes a printer unit 5 and a scanner unit 6. The printer unit 5 includes the line head 10 that performs recording by ejecting ink, which is a liquid, on the medium P. In the present embodiment, the printer unit 5 is configured as a so-called ink jet printer that performs printing by ejecting ink, which is a liquid, on the medium P from the line head 10.

A plurality of medium storage cassettes 7 are provided in an apparatus lower portion of the recording unit 2. The recording operation is performed by having the medium P stored in the medium storage cassette 7 pass through a feeding path 11 depicted by a solid line in the recording unit 2 in FIG. 1 and by having the medium be sent to an area in which recording is performed by the line head 10. The medium P on which recording has been performed with the line head 10 is sent either to a first discharge path 12 that is a path through which the medium P is discharged to a post-recording discharge tray 8 provided above the line head 10 or to a second discharge path 13 that is a path through which the medium P is sent to the intermediate unit 3. In the recording unit 2 in FIG. 1, the first discharge path 12 is depicted with a broken line and the second discharge path 13 is depicted with a dot and dash line.

Furthermore, the recording unit 2 includes a reversing path 14 depicted by a two-dot chain line in the recording unit 2 in FIG. 1 and is configured to perform a double-sided recording that performs recording on a second surface of the medium P after performing recording on a first surface of the medium P and reversing the medium P.

One or more pairs of transport rollers (not shown) that are examples of members that transport the medium P are disposed in each of the feeding path 11, the first discharge path 12, the second discharge path 13, and the reversing path 14.

A control unit 15 that controls various operations of the recording system 1 is provided in the recording unit 2.

The intermediate unit 3 illustrated in FIG. 1 is disposed between the recording unit 2 and the processing unit 4. The intermediate unit 3 is configured to receive, through a receiving path 20, the medium P on which recording has been performed delivered from the second discharge path of the recording unit 2 and to transport the medium to the processing unit 4. The receiving path 20 is depicted by a solid line in the intermediate unit 3 illustrated in FIG. 1.

In the intermediate unit 3, there are two transport paths that transport the medium P. The first transport path is a path through which the medium P is transported from the receiving path 20, through a first switchback path 21, and to a discharge path 23. The second path is a path through which the medium P is transported from the receiving path 20, through a second switchback path 22, and to the discharge path 23.

The first switchback path 21 is a path through which the medium P is switched back in an arrow A2 direction after the medium P has been received in an arrow A1 direction. The second switchback path 22 is a path through which the medium P is switched back in an arrow B2 direction after the medium P has been received in an arrow B1 direction.

The receiving path 20 is branched into the first switchback path 21 and the second switchback path 22 at a branching portion 24. Furthermore, the first switchback path 21 and the second switchback path 22 are merged at a merging portion 25. Accordingly, the medium P sent from the receiving path 20 through either of the switchback paths can be delivered to the processing unit 4 through the common discharge path 23.

One or more pairs of transport rollers (not shown) are disposed in each of the receiving path 20, the first switchback path 21, the second switchback path 22, and the discharge path 23.

When recording is performed continuously on a plurality of mediums P in the recording unit 2, the mediums P that have entered the intermediate unit 3 are alternately sent to the transport path passing through the first switchback path 21 and to the transport path passing through the second switchback path 22. With the above, the medium transportation throughput in the intermediate unit 3 can be increased.

Note that the recording system 1 can be configured without the intermediate unit 3. In other words, a configuration in which the recording unit 2 and the processing unit 4 are coupled to each other, and the medium P on which recording has been performed in the recording unit 2 is directly sent to the processing unit 4 without passing through the intermediate unit 3 can be provided.

As in the present embodiment, when the medium P on which recording has been performed in the recording unit 2 is sent to the processing unit 4 through the intermediate unit 3, compared with when the medium P is sent directly to the processing unit 4 from the recording unit 2, the transport time is long; accordingly, the ink on the medium P can be turned drier before the medium is transported to the processing unit 4.

The processing unit 4 illustrated in FIG. 1 includes the processing portion 36 that performs a process on the medium P, and a discharge member 50 that discharges the medium P on which the process has been performed by the processing portion 36. Examples of the processes performed by the processing portion 36 include a stapling process and a punching process.

The medium P is delivered from the discharge path 23 of the intermediate unit 3 to a transport path 31 of the processing unit 4. A pair of transport rollers 32 that transport the medium P are provided upstream of the transport path 31 in a transport direction (+Y direction). Furthermore, a pair of discharge rollers 33 that are discharge members that discharge the medium P to the load tray 35 described later are provided downstream of the transport path 31 in the transport direction.

The medium P delivered from the intermediate unit 3 is transported in the +Y direction with the pair of transport rollers 32 and is discharged on the load tray 35 with the pair of discharge rollers 33. The medium P mounted on the load tray 35 may be discharged on the discharge tray 37 from the load tray 35 after a process is performed thereon by the processing portion 36, or a plurality of mediums P may be discharged on the discharge tray 37 without any process being performed thereon by the processing portion 36 after being stacked on the load tray 35 and aligning the end portions thereof in a discharge direction and the end portions thereof in the width direction.

Hereinafter, referring to FIG. 2, a description will be given on discharging and loading the medium P onto the load tray 35. Note that an illustration of second rear end aligning portions that constitute the medium aligning apparatus described later is omitted in FIG. 2.

The front end E2 of the medium P discharged from the pair of discharge rollers 33 lands on the load surface 35*a* of the load tray 35, and the medium P proceeds over the load surface 35*a* in the +Y direction until the rear end E1 leaves the nip between the pair of discharge rollers 33.

Figure 2:
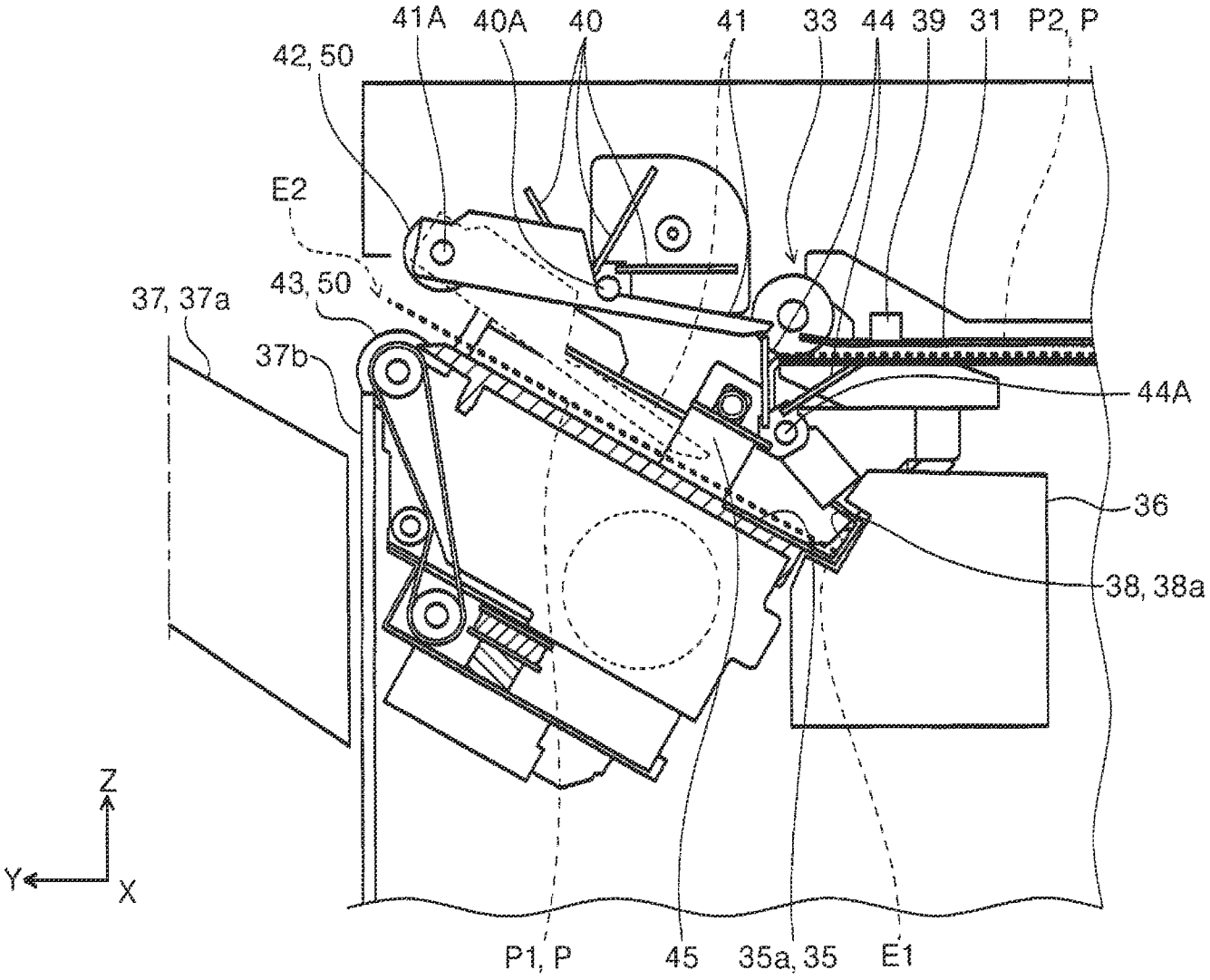
FIG. 2 is a sectional side view of a medium processing apparatus.

Guide members 41 are provided in the +Y direction with respect to the pair of discharge rollers 33, and while discharge of the medium P is performed by the pair of discharge rollers 33, the guide members 41 are positioned at a retracted position depicted by a solid line in FIG. 2 so that the guide members 41 do not interrupt the discharge of the medium P performed by the pair of discharge rollers 33. When the rear end E1 of the medium P leaves the nip between the pair of discharge rollers 33, the guide members 41 advance to an advanced position depicted by a broken line. In so doing, the medium P falls on the load surface 35*a* by its own weight and is reliably mounted on the load surface 35*a* with the guide members 41 that have been displaced from the retracted position to the advanced position.

Figure 3:
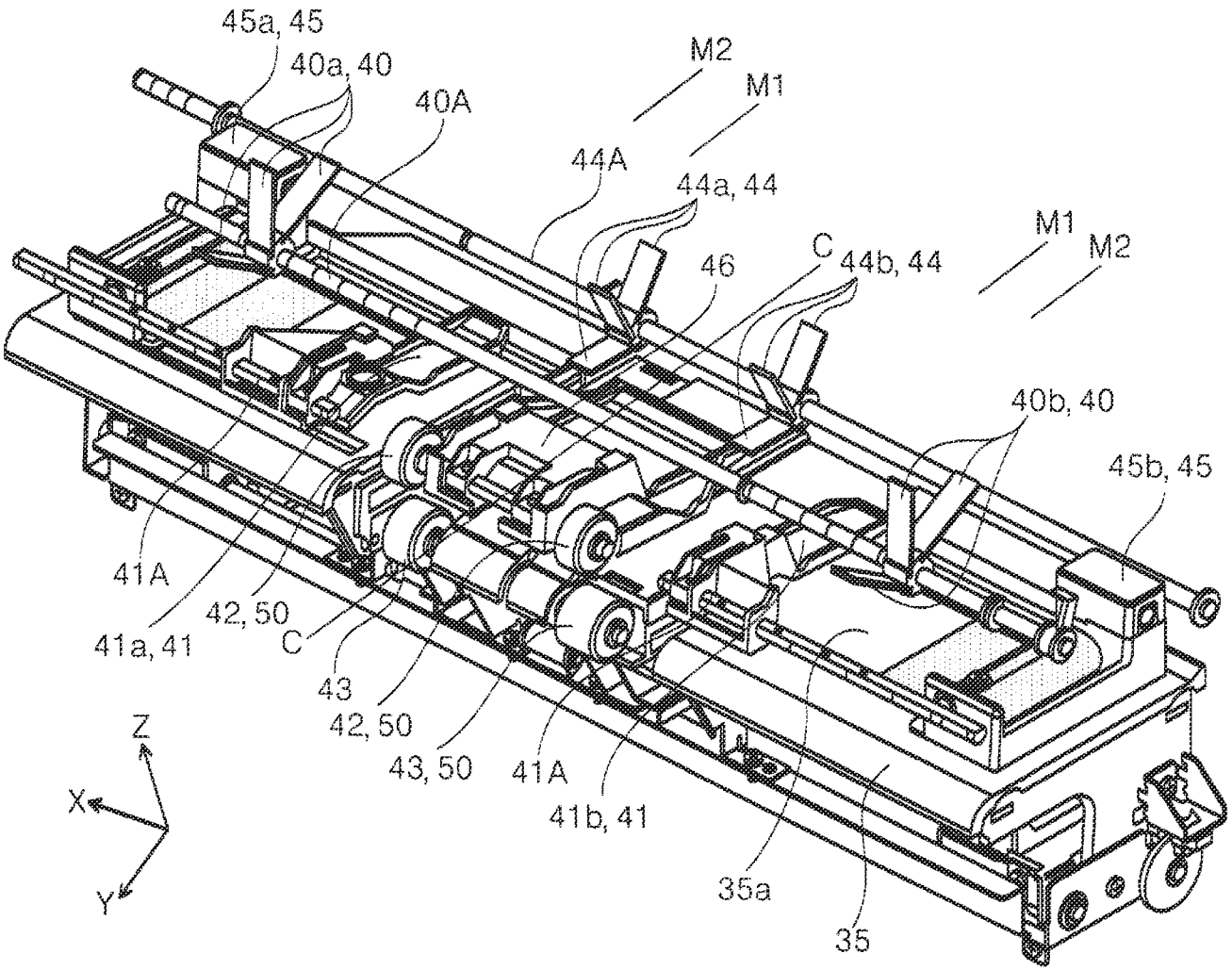
FIG. 3 is a perspective view of a medium discharging apparatus.

Paddles 40 that come in contact with the medium P discharged on the load tray 35 and that rotate to move the medium P towards first rear end aligning portions 38 are provided above the load tray 35. As illustrated in FIG. 3, the paddles 40 and the guide members 41 are each provided on both sides of a center C in the width direction so as to be disposed symmetrical against the center C. Paddles 40*a* and a guide member 41*a* are provided in the +X direction with respect to the center C, and paddles 40*b* and a guide member 41*b* are provided in the −X direction with respect to the center C.

Each paddle 40 is a plate-shaped member, and a plurality of plate-shape members are attached at intervals along an outer circumference of a rotation shaft 40A. The +Y direction, which is downstream in the discharge direction, of each guide member 41 is attached to a pivot shaft 41A, and each guide member 41 is configured pivotable with the −Y direction thereof as a free end.

When the medium P is mounted on the load surface 35*a*, the paddles 40 rotate in the counterclockwise direction in FIG. 2. By rotating the paddles 40 in contact with the medium P, the medium P is advanced in the −Y direction. Since the load surface 35*a* of the load tray 35 is inclined upwards in the +Y direction, the medium P is advanced in the −Y direction with the inclination as well.

The first rear end aligning portions 38 that align the rear end E1 of the medium P are provided in the load tray 35 in the −Y direction. Note that in the present exemplary embodiment, second rear end aligning portions 104 (see FIGS. 4 to 7) are further included in addition to the first rear end aligning portions 38, which will be described in detail later.

When the rear ends E1 move in the direction extending towards the first rear end aligning portions 38 or the second rear end aligning portions 104 described later, and when the rear ends E1 are abutted against the first rear end aligning portions 38 or the second rear end aligning portions 104 described later, the positions of the rear ends E1 of the mediums P mounted on the load tray 35 are arranged, or aligned.

Note that in the present embodiment, auxiliary paddles 44 that rotate about a rotation shaft 44A are provided below the pair of discharge rollers 33. The auxiliary paddles 44 are disposed in the −Y direction with respect to the paddles 40, and similar to the paddles 40, rotate counterclockwise in FIG. 2. By providing the auxiliary paddles 44, the medium P can be abutted and aligned against the first rear end aligning portions 38 and the second rear end aligning portions 104 in a more reliable manner.

Furthermore, a width direction aligning member 45 that aligns the end portions of the mediums P in the width direction is provided on the load tray 35. As illustrated in FIG. 3, the width direction aligning member 45 includes a first aligning portion 45*a* that is provided in the +X direction with respect to the center C in the width direction, and a second aligning portion 45*b* that is provided in the −X direction with respect to the center C. After the mediums P have been mounted between the first aligning portion 45*a* and the second aligning portion 45*b*, the width direction aligning member 45 aligns the end portions of the mediums P in the width direction by having the first aligning portion 45*a* and the second aligning portion 45*b* approach each other and abut against the end portions of the mediums P in the width direction.

When a plurality of mediums P are continuously mounted on the load tray 35, after performing, on a medium P1 discharged first, aligning of the rear end E1 using the paddles 40 and aligning the end portions on both sides in the width direction using the width direction aligning member 45, the guide members 41 are returned to the retracted position before the next medium P2 is discharged from the pair of discharge rollers 33.

The timing at which the guide members 41 are displaced between the retracted position and the advanced position, the timing at which the paddles 40 are rotated, and the timing at which the aligning operation is performed with the width direction aligning members 45 can be determined based on a detection of the medium P with a medium detection member 39 provided upstream of the pair of discharge rollers 33. For example, each of the operations can be performed after a passage of a predetermined time from when the rear end E1 of the medium P has been detected with the medium detection member 39.

A process such as a stapling process is performed on a plurality of mediums P mounted on the load tray 35 after the rear ends E1 of the mediums P and both end portions thereof in the width direction have been aligned with the processing portion 36 illustrated in FIG. 2. The mediums P after the process has been performed thereon with the processing portion 36 are discharged from the load tray 35 to the discharge tray 37 with the discharge member 50 including upper rollers 42 and lower rollers 43.

Note the plurality of mediums P in which the end portions have been aligned in the load tray 35 can be discharged from the load tray 35 to the discharge tray 37 as they are as a stack of mediums without performing the process with the processing portion 36.

The lower rollers 43 constituting the discharge member 50 are rotationally driven by a motor (not shown), and the upper rollers 42 in contact with the medium P is driven so as to follow the drive of the lower rollers 43. More specifically, as illustrated in FIG. 3, the lower rollers 43 are rotatably attached to the load tray 35, and the upper rollers 42 are rotatably attached to a roller holder 46. Each of the upper rollers 42 and each of the lower rollers 43 are disposed symmetrically against the center C in the width direction.

The roller holder 46 supporting the upper rollers 42 is provided so as to be pivotable about a pivot shaft (not shown), and is, with a drive source (not shown), switchable between a separated state in which the upper rollers 42 are separated from the lower rollers 43 and an approaching state in which the upper rollers 42 approach the lower rollers 43.

While the medium P is discharged through the pair of discharge rollers 33 to the load tray 35, the upper rollers 42 are in the separated state. Furthermore, when the mediums P mounted on the load tray 35 are discharged to the discharge tray 37, the upper rollers 42 are set to the approaching state and the mediums P are nipped between the upper rollers 42 and the lower rollers 43 and are sent to an upper portion of the discharge tray 37. Subsequently, when the rear ends E1 of the mediums P pass through the nip between the upper rollers 42 and the lower rollers 43, the stack of mediums P fall with its own weight and is mounted on the discharge tray 37.

Note that reference numeral 37*b* is a wall surface positioned in the −Y direction with respect to the discharge tray 37. The rear end E1 of the medium P mounted on the discharge tray 37 abuts against the wall surface 37*b*. Note that in the present exemplary embodiment, a support surface 37*a* of the discharge tray 37 that supports the medium P is inclined upwards towards the +Y direction; accordingly, the medium P discharged to the discharge tray 37 slides in the −Y direction and the rear end E1 thereof abuts against the wall surface 37*b*.

Note that in the present exemplary embodiment, the wall surface 37*b* is provided to extend in the vertical direction. In other words, the wall surface 37*b* is a surface parallel to the vertical direction.

First Exemplary Embodiment

Referring next to FIGS. 4 to 7, a detailed description of a medium aligning apparatus 100A that aligns the rear ends E1 of the mediums P will be given. The medium aligning apparatus 100A is a first exemplary embodiment of the medium aligning apparatus.

In addition to the first rear end aligning portions 38 that position and align the rear ends of the mediums P, the medium aligning apparatus 100A according to the present exemplary embodiment further includes the second rear end aligning portions 104 that position and align the rear ends of the medium P. The medium aligning apparatus 100A is configured to switch between aligning using the first rear end aligning portions 38 and aligning using the second rear end aligning portions 104.

Note that while the illustration of the first rear end aligning portions 38 and the second rear end aligning portions 104 is omitted in FIG. 3, the first rear end aligning portions 38 and the second rear end aligning portions 104 are provided at positions shifted from each other in the width direction and, for example, the first rear end aligning portions 38 are provided at positions M1 in the width direction and the second rear end aligning portions 104 are provided at positions M2. Each of the first rear end aligning portions 38 and each of the second rear end aligning portions 104 are disposed symmetrical against the center C. Note that the first rear end aligning portions 38 may be provided at the positions M2 and the second rear end aligning portions 104 may be provided at the positions M1, or each of the aligning portions may be provided at other positions. In other words, each of the aligning portions may be provided at any position allowing the rear ends E1 of all of the mediums P anticipated to be used to be aligned.

Figure 4:
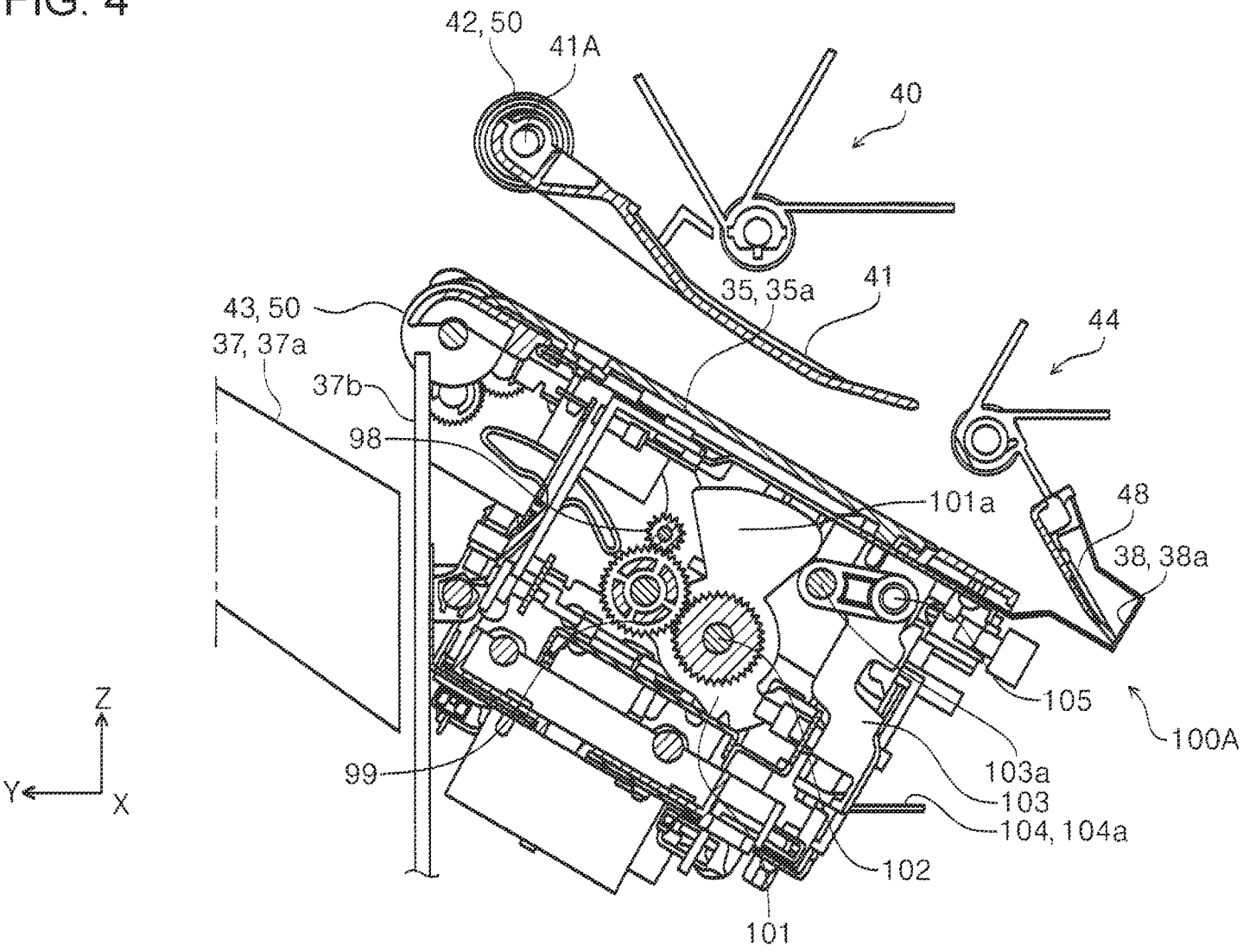
FIG. 4 is a side view of a medium aligning apparatus according to a first exemplary embodiment.
Figure 6:
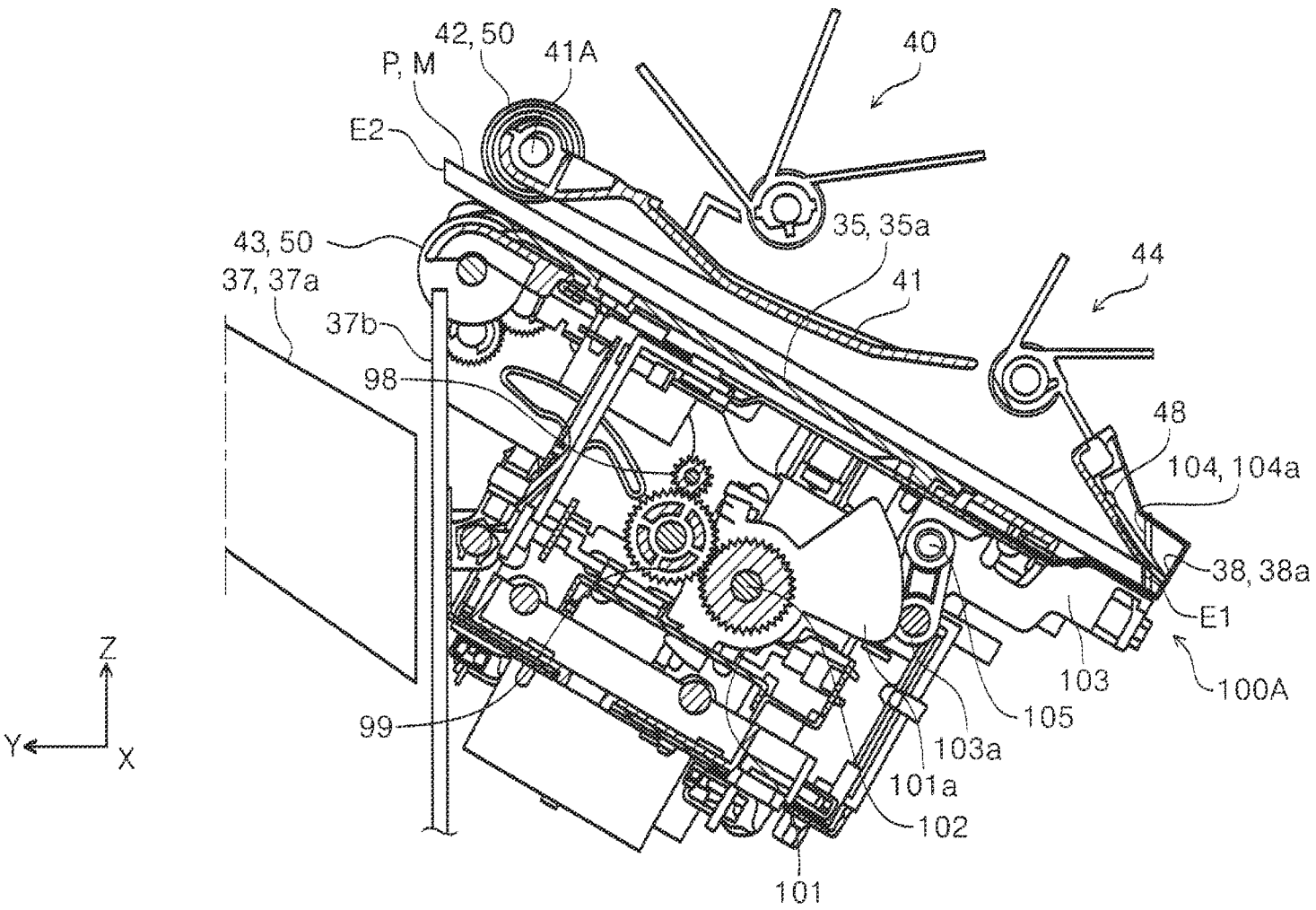
FIG. 6 is a side view of the medium aligning apparatus according to the first exemplary embodiment.

As illustrated in FIGS. 4 to 6, the medium aligning apparatus 100A includes cam members 101 and rotation members 103. The cam member 101 is rotatable about a rotation shaft 102 in a clockwise direction and in a counterclockwise direction in FIGS. 4 to 6. The cam member 101 is rotated by having driving force of a motor (not shown) transmitted thereto through gears 98 and 99. The cam member 101 includes a cam portion 101*a*, and the cam portion 101*a* rotates the adjacent rotation member 103.

The rotation member 103 includes a pushed portion 103*a* and the second rear end aligning portion 104. The rotation member 103 is rotatable about a rotation shaft 105 in the clockwise direction and in the counterclockwise direction in FIGS. 4 to 6. Spring force that rotates the rotation member 103 in the clockwise direction in FIGS. 4 to 6 is applied to the rotation member 103 with a spring (not shown), and the rotation caused by the spring force is stopped by the pushed portion 103*a* abutting against the cam portion 101*a*. Furthermore, when the cam member 101 rotates in the clockwise direction in FIG. 4, the cam portion 101*a* pushes the pushed portion 103*a* in the downwards direction in FIG. 4, and with the above, the rotation member 103 rotates in the counterclockwise direction in FIG. 4, which allows the rotation member 103 to change from the state illustrated in FIG. 4 to the state illustrated in FIG. 5. Note that when the cam member 101 in the state illustrated in FIG. 5 rotates in the counterclockwise direction in FIG. 5, the rotation member 103 can return to the state illustrated in FIG. 4 from the state illustrated in FIG. 5 by the spring force of the spring described above.

The second rear end aligning portion 104 is provided in the rotation member 103, and the second rear end aligning portion 104 is, due to the rotation of the rotation member 103, switchable between a first state in which, as illustrated in FIGS. 5 and 6, the second rear end aligning portion 104 advance above the load tray 35, and a second state in which, as illustrated in FIG. 4, the second rear end aligning portion 104 is retracted from the load tray 35. Note that the reference sign M in FIGS. 5 and 6 denote the stack of mediums P.

As illustrated in FIGS. 5 and 6, when each second rear end aligning portion 104 is in the first state, each second rear end aligning portion 104 is positioned in the +Y direction with respect to the corresponding first rear end aligning portion 38; accordingly, the rear ends E1 of the mediums P are not aligned by each first rear end aligning portion 38 and are aligned by each second rear end aligning portion 104. Conversely, as illustrated in FIG. 4, when each second rear end aligning portion 104 is in the second state, since each second rear end aligning portion 104 is retracted from the load tray 35, the rear ends E1 of the mediums P are aligned by each first rear end aligning portion 38.

Note that in FIGS. 4 to 6, the reference numeral 48 is a holddown member that holds down the end portion area of the medium P in the −Y direction from above. The holddown member 48 is pressed in a direction holding down the end portion area of the medium P in the −Y direction from above with a spring (not shown).

Subsequently, the aligned stack M of mediums P is nipped between the descended upper rollers 42 and the lower rollers 43 as illustrated in FIG. 6, and is discharged to the discharge tray 37.

Figure 7:
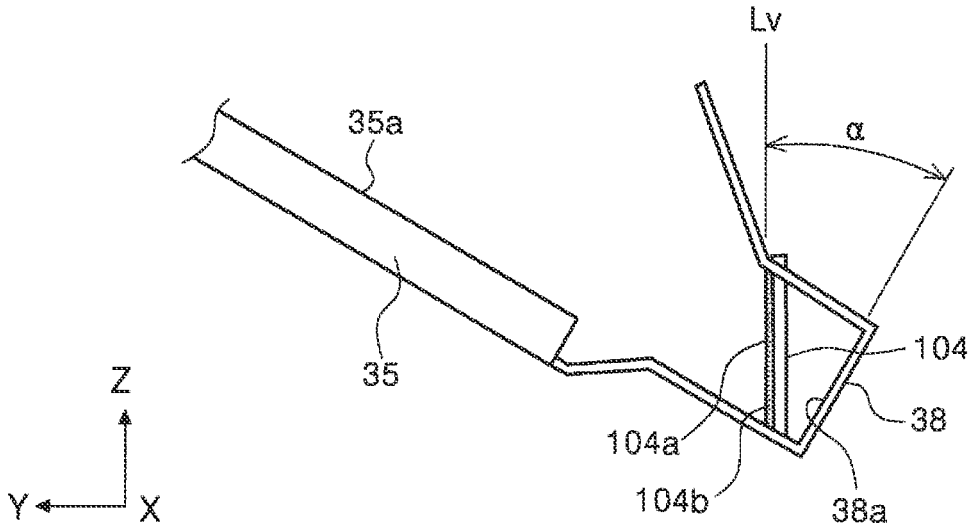
FIG. 7 is a side view of a first rear end aligning portion and a second rear end aligning portion illustrated in an enlarged manner.

As illustrated in FIG. 7, each second rear end aligning portion 104 includes a second aligning surface 104*a* that aligns the rear ends E1 of the mediums P. A straight line Lv in FIG. 7 is a straight line that is parallel to the wall surface 37*b* (see FIGS. 4 to 6) against which the rear ends E1 of the mediums P discharged to the discharge tray 37 abuts, and as described above, in the present exemplary embodiment, is a straight line parallel to the vertical direction.

Furthermore, as illustrated in FIG. 7, when the second rear end aligning portion 104 is advanced above the load tray 35, the second aligning surface 104*a* is parallel to the straight line Lv, in other words, the angle formed between the wall surface 37*b* and the second aligning surface 104*a* is 0'.

On the other hand, in FIG. 7, an angle α is an angle formed between a first aligning surface 38*a* of the first rear end aligning portion 38 against which the rear ends E1 of the mediums P abut and the wall surface 37*b*.

Figure 22:
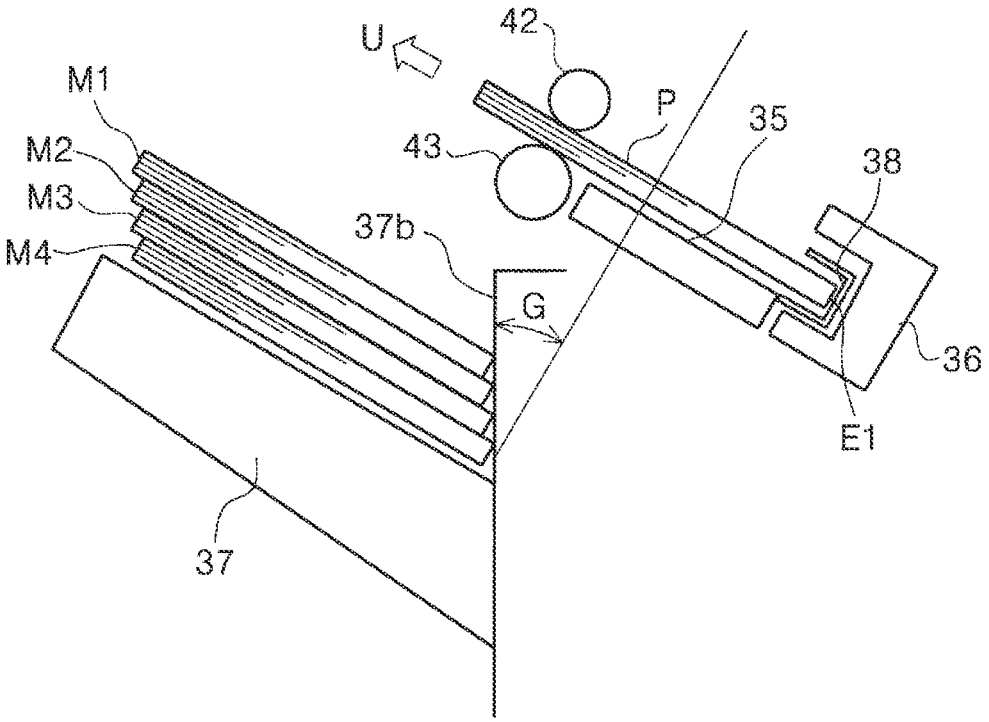
FIG. 22 is a side view of a medium processing apparatus according to a known technique.

As it is apparent from FIG. 7, the angle formed between the wall surface 37*b* and the second aligning surface 104*a* is smaller than the angle α formed between the wall surface 37*b* and the first aligning surface 38*a*; accordingly, by selecting the second aligning surface 104*a*, the mediums P discharged onto the discharge tray 37 can be prevented from being loaded in a stepwisely displaced manner, which has been described while referring to FIG. 22. As a result, the usability for the user is improved and damage can be suppressed from occurring at the rear ends E1 of the mediums P.

Note that the second aligning surface 104*a* in the present exemplary embodiment is formed of a highly frictional material 104*b*. With the above, when the rear ends E1 of the medium P abut against the second aligning surface 104*a*, the rear ends E1 can be suppressed from slipping down between the second aligning surface 104*a* and the other mediums P. For example, an elastic material such as cork, rubber, or elastomer can be used as the highly frictional material 104*b*.

Furthermore, in the present exemplary embodiment, the angle formed between the load surface 35*a* of the load tray 35 and the first aligning surface 38*a* is 90°, and the angle formed between the wall surface 37*b* and each second aligning surface 104*a* is 0°. In other words, the wall surface 37*b* and each second aligning surface 104*a* are parallel to each other. Note that the angle formed between the wall surface 37*b* and the second aligning surface 104*a* is an angle formed between the wall surface 37*b* and the second aligning surface 104*a* when the second aligning surface 104*a* aligns the rear ends E1 of the mediums P.

With the above, by selecting the first aligning surface 38*a*, an appropriate processing result can be obtained when performing a process on the mediums P loaded on the load tray 35 with the processing portion 36, for example, when stapling with a staple. Furthermore, when the second aligning surfaces 104*a* are selected and the aligning of the mediums P is performed, since the angle formed between the wall surface 37*b* and each second aligning surface 104*a* is 0°, the mediums P discharged onto the discharge tray 37 can be reliably prevented from being displaced in a stepwise manner.

Note that the angle formed between the load surface 35*a* of the load tray 35 and the first aligning surface 38*a* being 90° is not strictly limited to 90° and includes a certain degree of error caused by production tolerance or the like. Similarly, the angle formed between the wall surface 37*b* and each second aligning surface 104*a* being 0° and the wall surface 37*b* and the second aligning surface 104*a* being parallel to each other are not strictly limited to 0° or strictly being parallel to each other and includes a certain degree of error caused by production tolerance or the like.

Accordingly, by aligning the rear ends E1 of the mediums P using the second aligning surfaces 104*a*, the control unit 15 (see FIG. 1) that controls various operations in the recording system 1 will be capable of preventing the mediums P discharged onto the discharge tray 37 from being loaded in a stepwisely displaced manner and, consequently, will be able to improve usability for the user and prevent damage at the rear ends E1 of the mediums P when, at least, the process is, with the processing portion 36, not performed on the mediums P that are to be loaded on the load tray 35.

Furthermore, by aligning the rear ends E1 of the mediums P using the first aligning surface 38*a*, the control unit 15 can obtain an appropriate processing result when the processing portion 36 is to perform a process on the mediums P loaded on the load tray 35.

Note that in the present exemplary embodiment, the angle formed between the wall surface 37*b* and each second aligning surface 104*a* is 0°; however, a certain angle may be formed therebetween.

Furthermore, in the present exemplary embodiment, since the first aligning surface 38*a* and the second aligning surfaces 104*a* are formed of different members, the degree of freedom of designing the angle formed between the first aligning surface 38*a* and the load surface 35*a*, and that of the angle formed between the second aligning surfaces 104*a* and the wall surface 37*b* are improved.

Furthermore, in the present exemplary embodiment, the second rear end aligning portion 104 including the second aligning surface 104*a* is provided in the rotatable rotation member 103, and by rotation of the rotation member 103, the first state in which the second aligning surface 104*a* advances above the load tray 35 and the second state in which the second aligning surface 104*a* is retracted from above the load tray 35 can be switched; accordingly, a state in which the first aligning surface 38*a* is used and a state in which each second aligning surface 104*a* is used can be switched with a simple configuration.

Second Exemplary Embodiment

Figure 8:
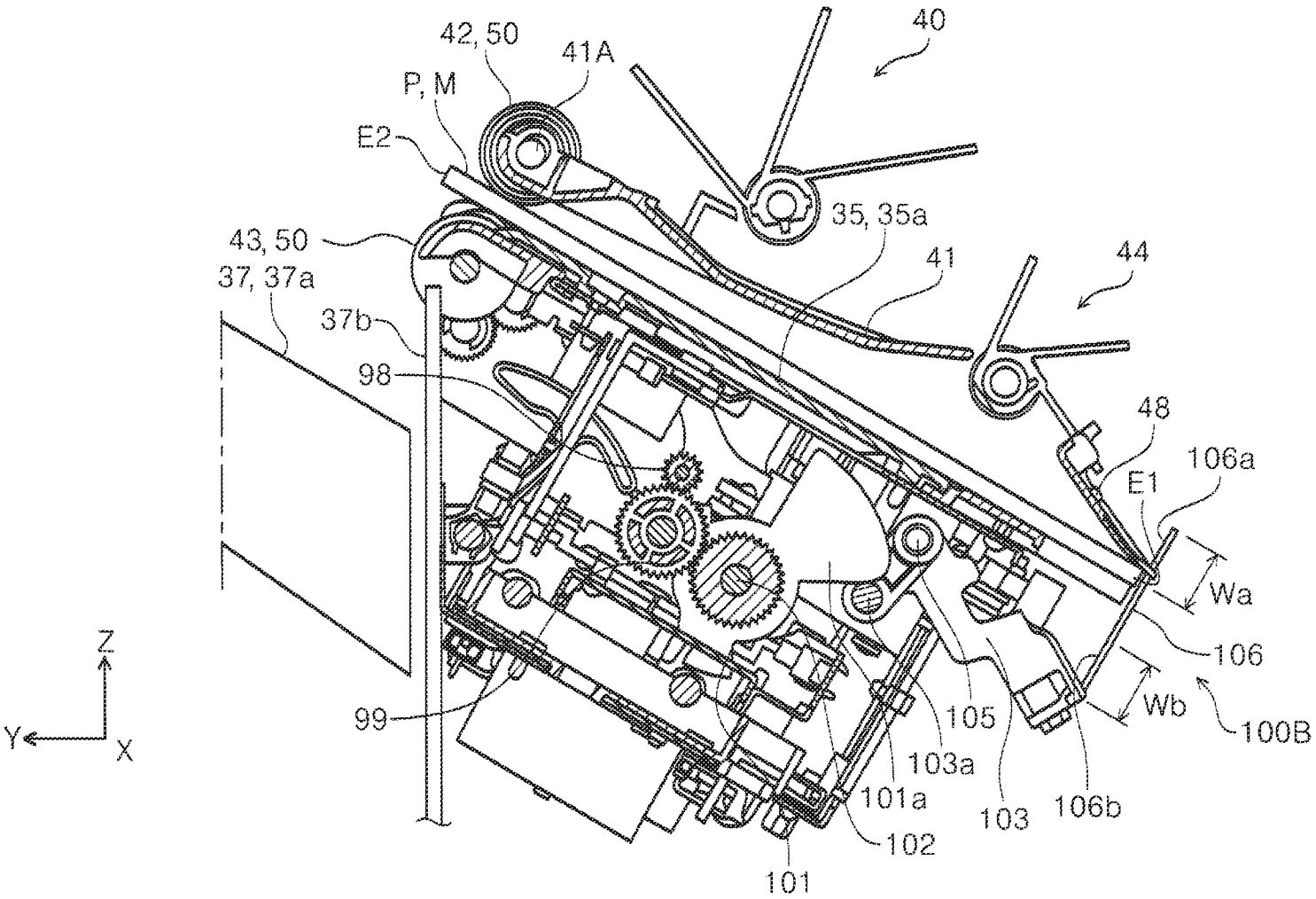
FIG. 8 is a side view of a medium aligning apparatus according to a second exemplary embodiment.
Figure 9:
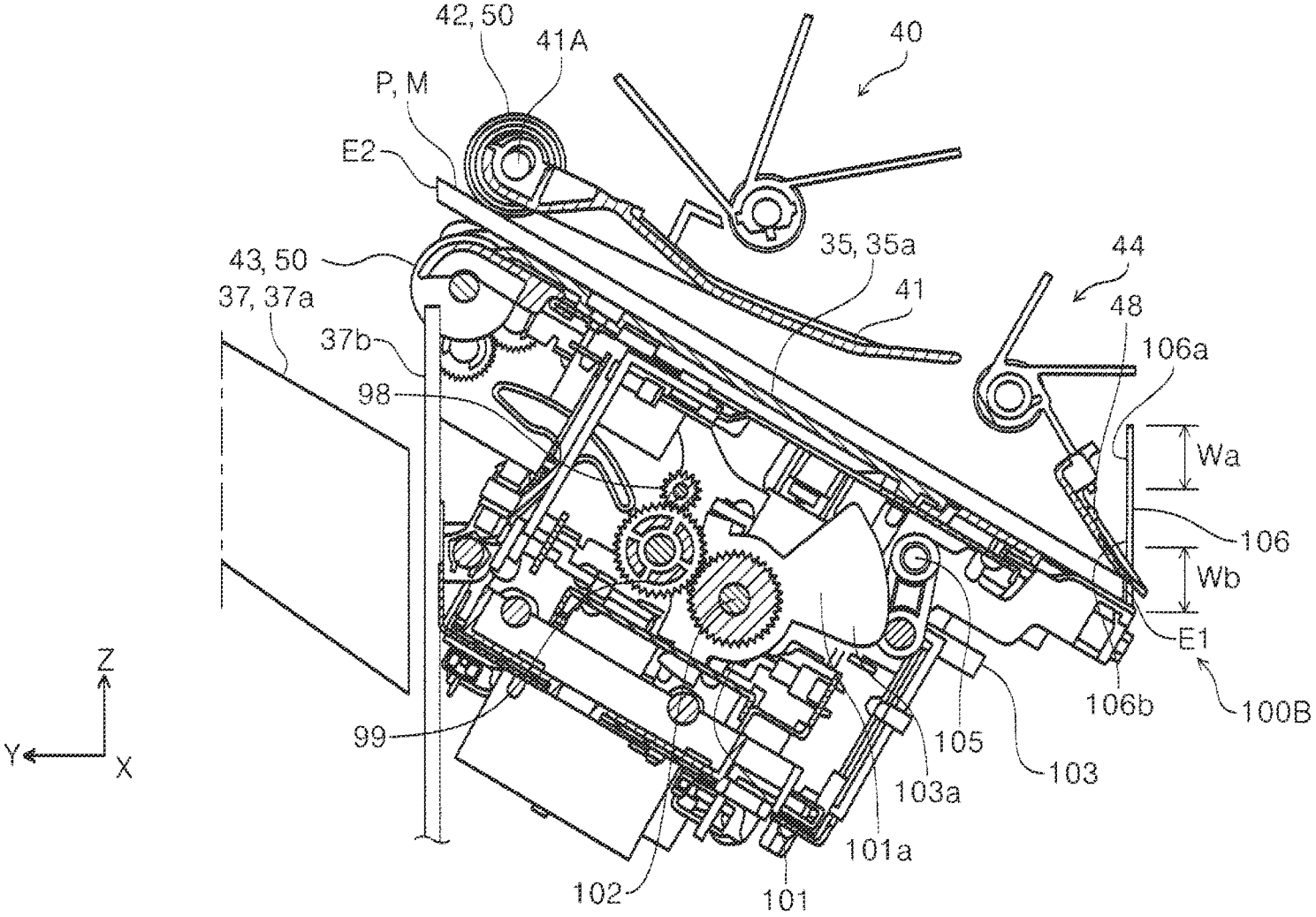
FIG. 9 is a side view of the medium aligning apparatus according to the second exemplary embodiment.

Referring next to FIGS. 8 and 9, a detailed description of a medium aligning apparatus 100B will be given. The medium aligning apparatus 100B is a second exemplary embodiment of the medium aligning apparatus.

In the present exemplary embodiment, the first aligning surface and the second aligning surface are formed of the same member. In FIGS. 8 and 9, the reference numeral 106*a* is a first aligning surface corresponding to the first aligning surface 38*a* of the first exemplary embodiment described above, and the reference numeral 106*b* is a second aligning surface that corresponds to the second aligning surface 104*a* of the first exemplary embodiment described above. The first aligning surface 106*a* and the second aligning surface 106*b* are both provided in a rear end aligning portion 106, in other words, the first aligning surface 106*a* and the second aligning surface 106*b* are formed of the same member. With the above, a cost reduction in the apparatus can be achieved.

Note that an area depicted by an arrow Wa is the area of the first aligning surface 106*a*, and an area depicted by an arrow Wb is the area of the second aligning surface 106*b*. Note that similar to the first exemplary embodiment described above, desirably, alignment surfaces in the present exemplary embodiment are each formed of a highly frictional material.

Similar to the first exemplary embodiment described above, the rear end aligning portion 106 in the present exemplary embodiment is provided in the rotation member 103. Furthermore, since a first state (see FIG. 9) in which the rear ends E1 of the mediums P are aligned by the second aligning surface 106*b* and a second state (see FIG. 8) in which the rear ends E1 of the mediums P are aligned by the first aligning surface 106*a* are switchable by rotation of the rotation member 103, the first state and the second state can be switched with a simple configuration.

Third Exemplary Embodiment

Figure 10:
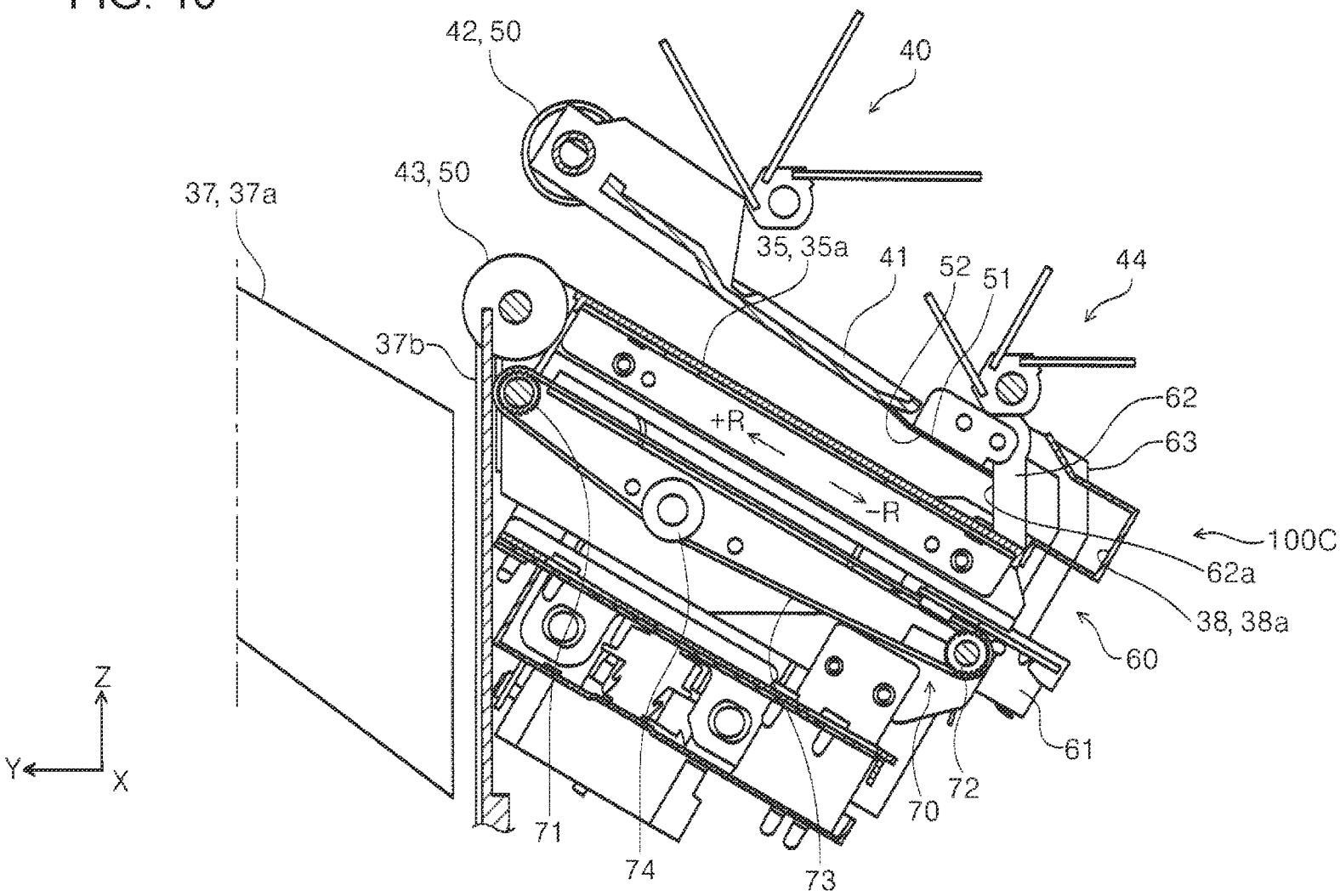
FIG. 10 is a side view of a medium aligning apparatus according to a third exemplary embodiment.

Referring next to FIG. 10 and the succeeding drawings, a detailed description of a medium aligning apparatus 100C will be given. The medium aligning apparatus 100C is a third exemplary embodiment of the medium aligning apparatus.

The medium aligning apparatus 100C includes first curl suppressing members 51, link mechanisms 60, cam mechanisms 80, and belt driving mechanisms 70.

A description of the first curl suppressing members 51 will be given first. The first curl suppressing members 51 are disposed symmetrically against the center C (see FIG. 3) in the width direction and, for example, are disposed at the positions M2 in FIG. 3. The first curl suppressing members 51 are disposed on the outer side in the width direction with respect to the upper rollers 42 and the lower rollers 43.

Figure 17:
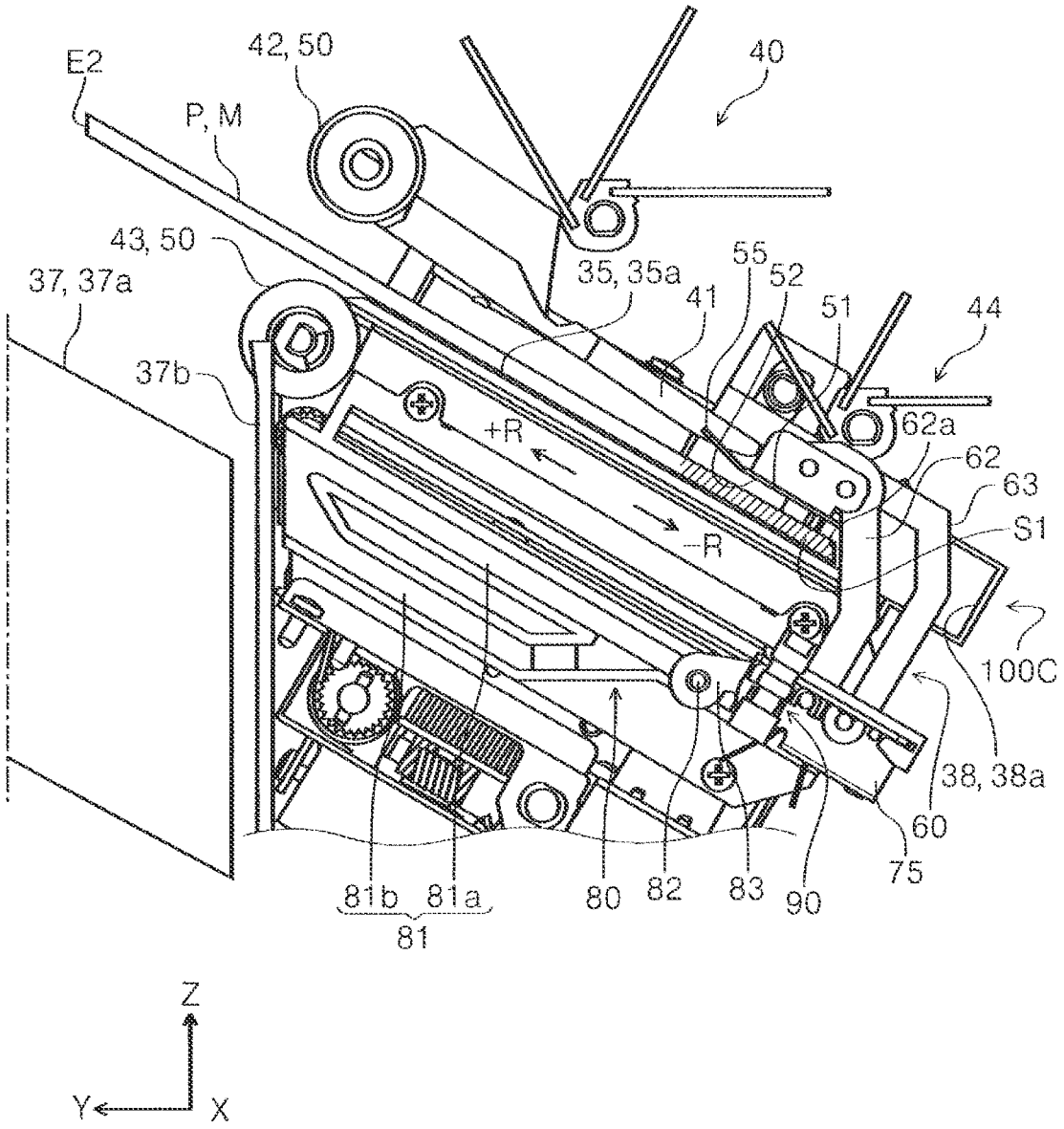
FIG. 17 is a side view of the medium aligning apparatus according to the third exemplary embodiment.

As illustrated in FIG. 17, each first curl suppressing member 51 is positioned above a rear end area S1 that includes the rear end E1 of the discharged medium P in the load tray 35.

Note that the rear end area S1 is an area in the medium P opposing an opposing surface 52 of each first curl suppressing member 51. Furthermore, in the present exemplary embodiment, while the rear end area S1 includes the rear end E1, the rear end area S1 does not necessarily have to include the rear end E1. In other words, the rear end area S1 may be any area as long as a middle position of the rear end area S1 in the discharge direction is on the rear end side with respect to a middle position of the medium P in the discharge direction.

Figure 20:
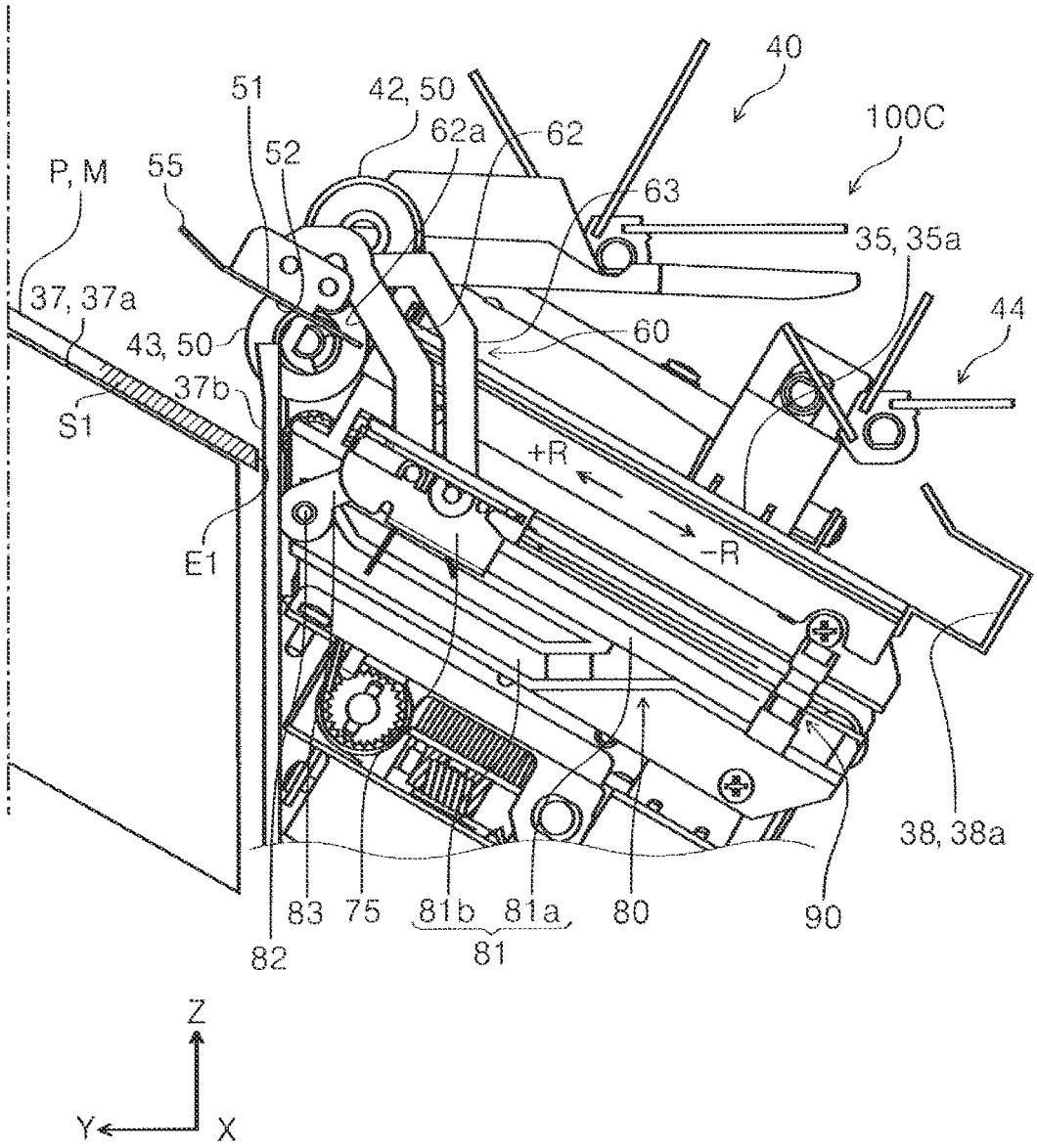
FIG. 20 is a side view of the medium aligning apparatus according to the third exemplary embodiment.

Note that a feature of the first curl suppressing members 51 is that the first curl suppressing members 51 are positioned above the rear end area S1 of the mediums P and move while maintaining the positions until the stack M of mediums P is discharged to the discharge tray 37 from the load tray 35 with the discharge member 50, in other words, from a state in FIG. 17 until a state in FIG. 20.

In other words, each first curl suppressing member 51 follows the movement of the mediums P without changing the position relative to the rear end area S1 of the mediums P and without changing the position until the mediums P are discharged from the load tray 35 to the discharge tray 37.

With the above, the first curl suppressing members 51 suppress the curling of the rear end area S1 of the mediums P until the mediums P are discharged from the load tray 35 to the discharge tray 37 with the discharge member 50, and the first curl suppressing members 51 moving while following the discharged mediums P can be prevented from contacting the mediums P and affecting the positions and the aligned state of the mediums P. Furthermore, incidents such as force, which is exerted by the first curl suppressing members 51, rubbing the stacked medium against each other can be reduced. Note that the configuration that moves the first curl suppressing member 51 in the discharge direction will be described later.

As illustrated in FIG. 17, each first curl suppressing member 51 is disposed at a position at which the first curl suppressing member 51 does not come in contact with the stack of mediums P, the number of which is the largest that can be mounted on the load tray 35 when the mediums P are not curled, in other words, the first curl suppressing member 51 is disposed at a position that does not come in contact with the rear end area S1 of the medium stack M. Furthermore, each first curl suppressing member 51 is at a position that comes in contact with the rear end area S1 of the mediums P when the mediums P are curled. In other words, as illustrated in FIG. 17, each first curl suppressing member 51 is disposed with a gap in between the rear end area S1 of the mediums P that are not curled. Even when there is only one medium P mounted on the load tray 35, each first curl suppressing member 51 is disposed so as to be in contact with the rear end area S1 of the medium P when the medium P is curled.

With the above, while lifting of the curled rear end area S1 of the mediums P can be suppressed with the first curl suppressing members 51, the first curl suppressing members 51 can be prevented from unexpectedly coming into contact with the mediums P that are not curled.

Furthermore, the first curl suppressing member 51 illustrated in FIGS. 17 to 20 includes the opposing surface 52 that opposes the mediums P. The opposing surface 52 moves while maintaining the position parallel to the mediums P. With the above, curling of the rear end area S1 of the mediums P can be suppressed in a further appropriate manner.

Note that in the present exemplary embodiment, the load tray 35 and the discharge tray 37 are formed so as to be parallel to each other. Accordingly, regardless of whether the medium stack M is on the load tray 35 or is on the discharge tray 37, the first curl suppressing member 51 can have the opposing surface 52 maintain the position parallel to the mediums P.

Furthermore, the first curl suppressing member 51 includes, in the +Y direction of the opposing surface 52, an inclined surface 55 that is continuous to the opposing surface 52. By providing the inclined surface 55 in the first curl suppressing member 51, it will be easier to receive the mediums P below the opposing surface 52.

A specific configuration that moves each first curl suppressing member 51 while maintaining the position thereof will be described next. Hereinafter, the link mechanism 60, the cam mechanism 80, and the belt driving mechanism 70 will be described in particular.

As illustrated in FIGS. 11 to 14, the link mechanism 60 is formed of a so-called four-joint link mechanism. The link mechanism 60 includes first arm portions 61 provided in a direction in which the link mechanism 60 moves relative to the load tray 35, second arm portions 62 and a third arm portion 63 that are pivotable while maintaining a state parallel to the first arm portions 61, and fourth arm portions 64 that are disposed parallel to the first arm portions 61 and that are pivotable relative to the second arm portion 62 and the third arm portion 6.

The second arm portions 62 are pivotably coupled to the first arm portions 61 at a first pivot portion 65 and is pivotably coupled to the fourth arm portions 64 at a second pivot portion 67. The third arm portion 63 is pivotably coupled to the first arm portions 61 at a third pivot portion 66 and is pivotably coupled to the fourth arm portions 64 at a fourth pivot portion 68.

The first arm portions 61 are provided in a pair with a gap in between in the width direction. Furthermore, the second arm portions 62 having a gap in between are provided in a pair between the first arm portions 61 and 61. One third arm portion 63 is provided between the second arm portions 62 and 62. The fourth arm portions 64 having a gap in between are provided in a pair on the outside of the second arm portions 62 and 62. The first curl suppressing member 51 is formed integrally together with the fourth arm portions 64 and 64 so as to be continuous with lower portions of the fourth arm portions 64 and 64.

Figure 12:
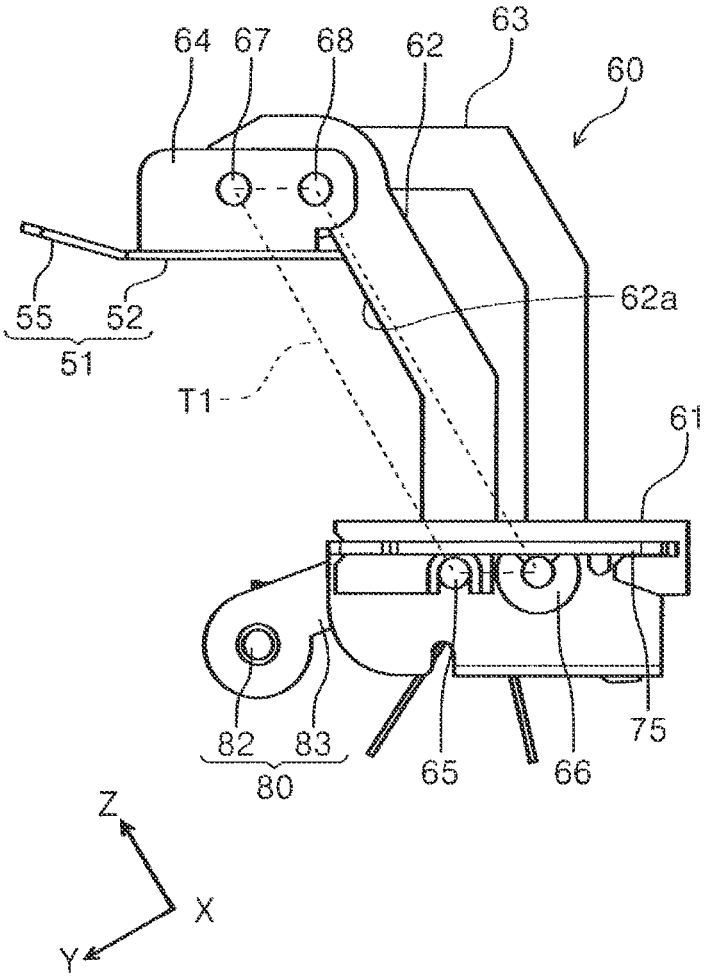
FIG. 12 is a side view of the link mechanism.

In FIG. 12, a parallelogram T1 is formed when the centers of the first pivot portion 65, the second pivot portion 67, the third pivot portion 66, and the fourth pivot portion 68 are connected.

Figure 13:
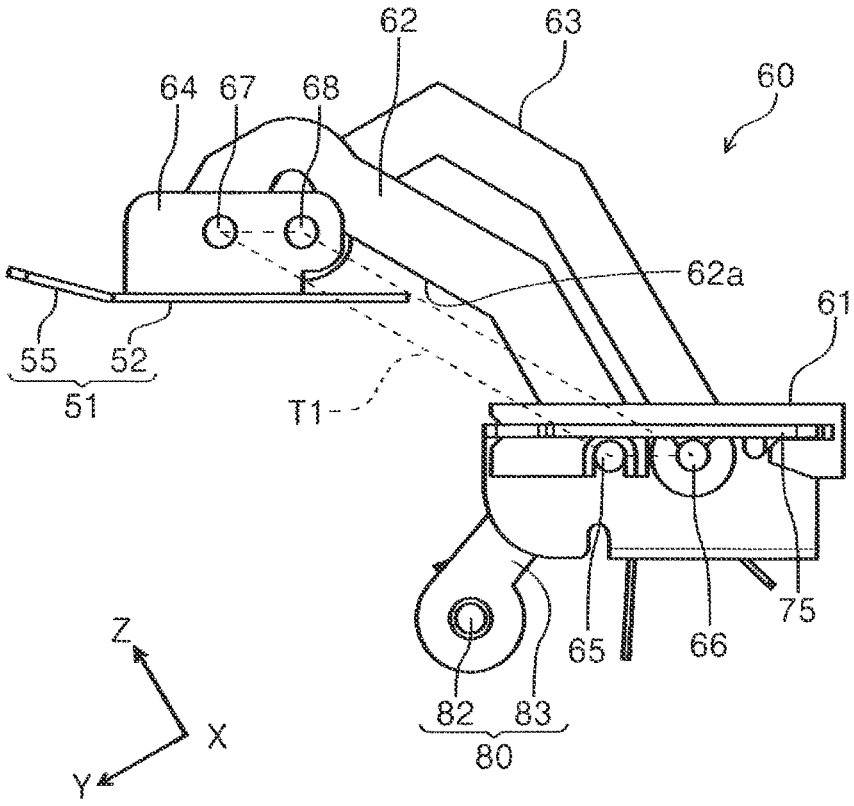
FIG. 13 is a side view of the link mechanism.
Figure 14:
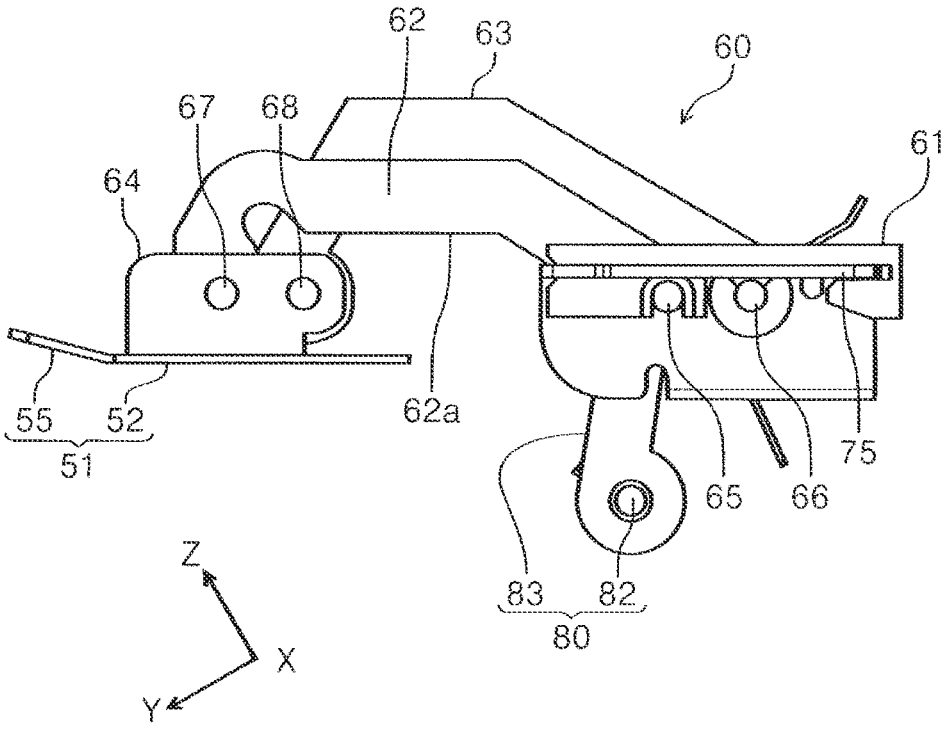
FIG. 14 is a side view of the link mechanism.

Cam members 83 that constitute the cam mechanism 80 are fixed to end portions of the second arm portions 63 on the first pivot portion 65 side. Referring to FIG. 12, when the cam members 83 are rotated counterclockwise, the second arm portions 62 having the first pivot portion 65 as an axis are rotated counterclockwise, and the third arm portion 63 is rotated while maintaining the parallel state with the second arm portions 62. Subsequently, the fourth arm portions 64 moves in a parallel manner in a direction approaching the first arm portions 61. Since the first curl suppressing member 51 is provided in the fourth arm portions 64, the location of the first curl suppressing member 51 in the height direction can be changed while maintaining the position thereof. In FIG. 13, a parallelogram T2 that is flatter than the parallelogram T1 is formed when the centers of the first pivot portion 65, the second pivot portion 67, the third pivot portion 66, and the fourth pivot portion 68 are connected. Furthermore, in FIG. 14, the centers of the first pivot portion 65, the second pivot portion 67, the third pivot portion 66, and the fourth pivot portion 68 are aligned in a linear manner. In other words, with the rotation of the cam members 83, the link mechanism 60 changes from the state in FIG. 12 to the state in FIG. 14 while transitioning through the state in FIG. 13, or changes from the state in FIG. 14 to the state in FIG. 12 while transitioning through the state in FIG. 13.

Figure 11:
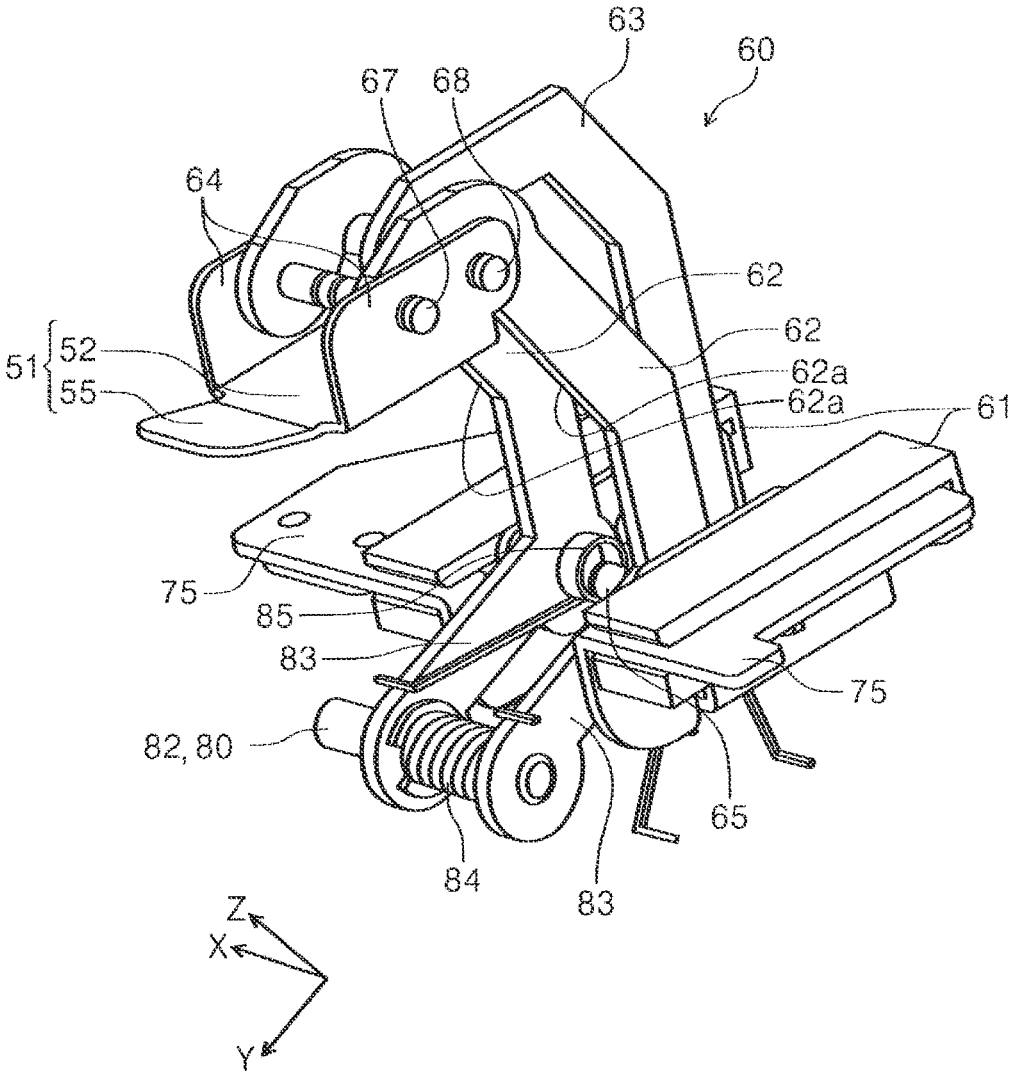
FIG. 11 is a perspective view of a link mechanism.

A torsion spring 85 illustrated in FIG. 11 is provided in the link mechanism 60. The torsion spring 85 presses the cam members 83 in the counterclockwise direction in FIGS. 12 to 14. Countering the pressing force of the torsion spring 85, the link mechanism 60 takes a position illustrated in FIG. 12. Note that a detailed configuration of the cam mechanism 80 that rotates the cam members 83 will be described after the belt driving mechanism 70 has been described.

A description of the belt driving mechanism 70 will be given next. The belt driving mechanism 70 illustrated in FIG. 10 is a mechanism that allows the first arm portion 61 to move both in a discharge direction +R and in a return direction −R that is a direction opposite the discharge direction.

The belt driving mechanism 70 includes a driving pulley 71 rotationally driven by a drive source (not shown), a driven pulley 72, and an endless belt 73 stretched across the driving pulley 71 and the driven pulley 72. A tension pulley 74 that applies tension on the endless belt 73 is provided inside the ring of the endless belt 73. The link mechanism 60 is attached to the endless belt 73 through a carriage portion 75. In FIG. 10, by having the endless belt 73 rotate in the counterclockwise direction, the link mechanism 60 including the first curl suppressing member 51 moves in the discharge direction +R, and by having the endless belt 73 rotate in the clockwise direction, the link mechanism 60 including the first curl suppressing member 51 moves in the return direction −R.

The cam mechanism 80 will be described next. The cam mechanism 80 pivots the second arm portion 62 in association with the movement of the first arm portion 61 in the discharge direction +R or in the return direction −R.

Figure 16:
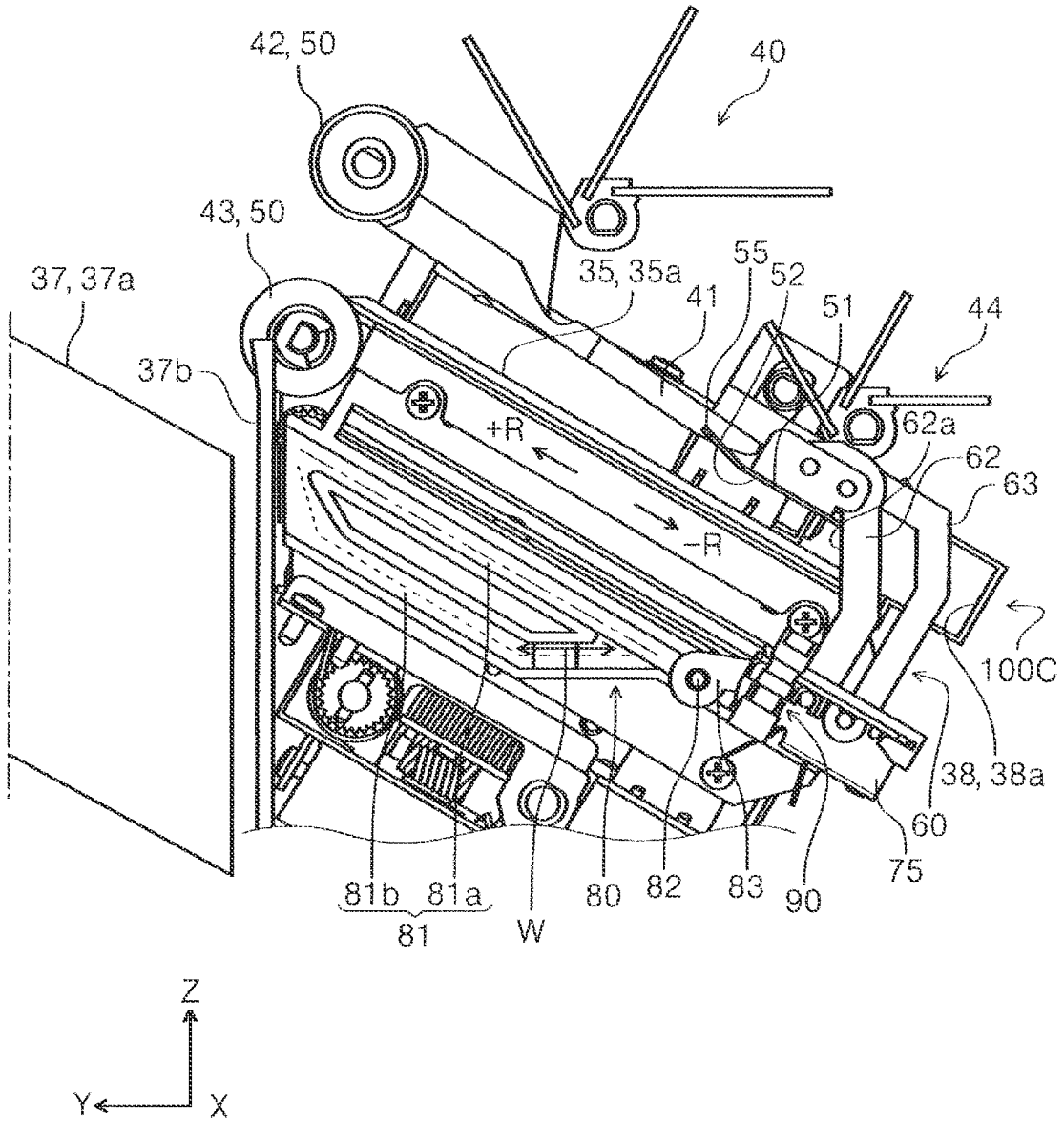
FIG. 16 is a side view of the medium aligning apparatus according to the third exemplary embodiment.

More specifically, as illustrated in FIG. 11, the cam mechanism 80 includes the cam members 83 fixed to the second arm portions 62 of the link mechanism 60, a guide pin 82 provided in the cam members 83, and a guide groove 81 that is, in FIG. 16, provided below the load tray 35 and that guides the guide pin 82. The guide groove 81 includes a first groove portion 81*a* through which the guide pin 82 passes when the link mechanism 60 moves in the discharge direction +R, and a second groove portion 81*b*, which is provided below the first groove portion 81*a* and through which the guide pin 82 passes when the link mechanism 60 moves in the return direction −R. In FIG. 16, a path in the first groove portion 81*a* through which the guide pin 82 passes is depicted by a dot and dash line, and a path in the second groove portion 81*b* through which the guide pin 82 passes is depicted by a broken line.

FIG. 17 illustrates a state in which the stack M of mediums P is mounted on the load tray 35 and in which the first curl suppressing member 51 is at a home position that is in the return direction −R. When the endless belt 73 of the belt driving mechanism 70 rotates in the counterclockwise direction in FIG. 17, the link mechanism 60 attached to the endless belt 73 through the carriage portion 75 moves in the discharge direction +R. In other words, the first curl suppressing member 51 moves in the discharge direction +R. Furthermore, the guide pin 82 provided in the cam members 83 is guided by the first groove portion 81*a* and is moved in the discharge direction +R.

Figure 18:
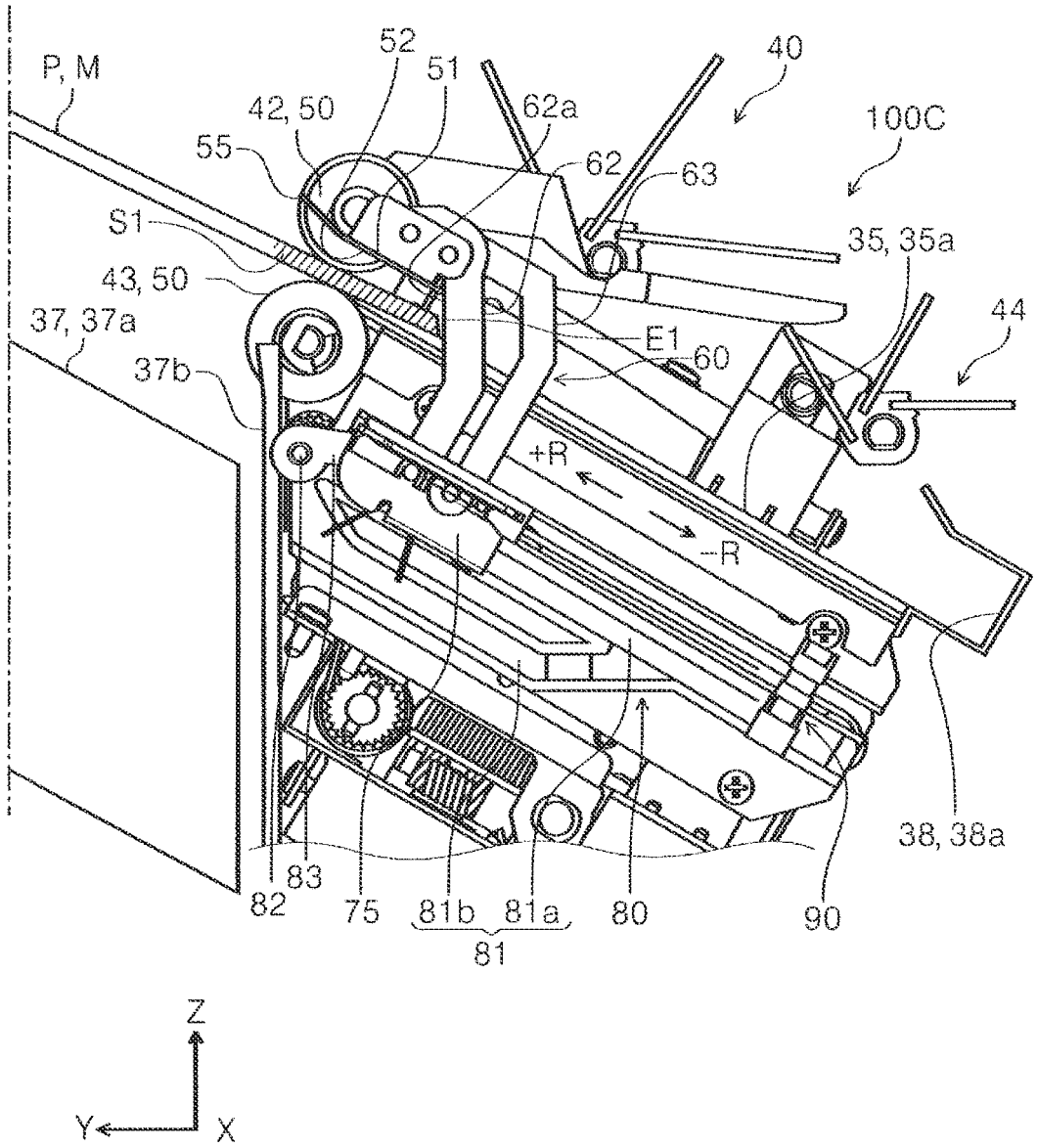
FIG. 18 is a side view of the medium aligning apparatus according to the third exemplary embodiment.
Figure 19:
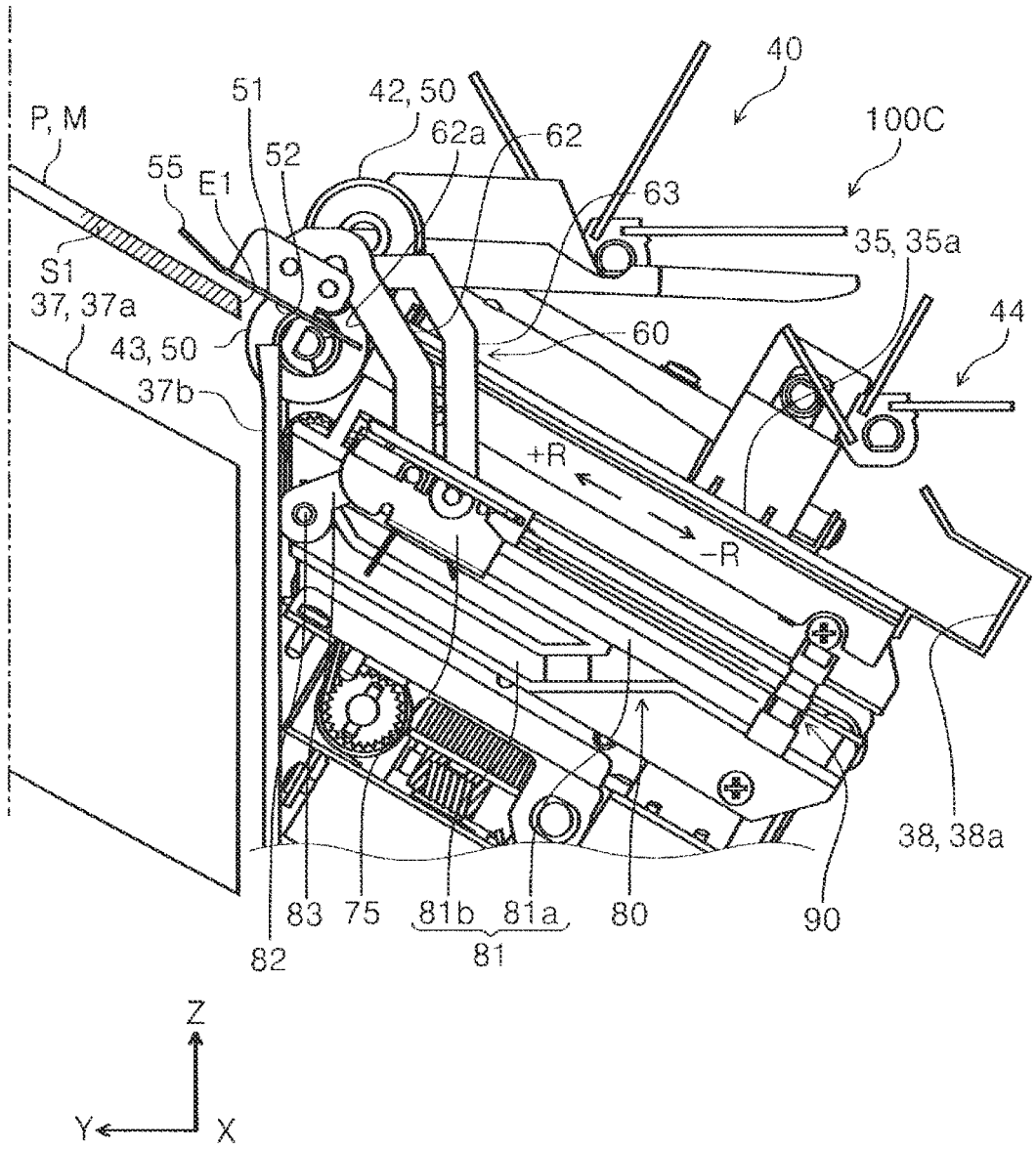
FIG. 19 is a side view of the medium aligning apparatus according to the third exemplary embodiment.

As illustrated in FIG. 18, when the guide pin 82 reaches the end portion of the first groove portion 81*a* on the discharge direction +R side, the guide pin 82 deviates from the first groove portion 81*a*. Subsequently, the second arm portions 62 and the cam members 83 fixed to the second arm portions 62 are rotated in the counterclockwise direction as illustrated in FIGS. 19 and 20 with the pressing force of the torsion spring 85 illustrated in FIG. 11. With the above, the first curl suppressing member 51 moves from above the load tray 35 so as to be positioned above the discharge tray 37. The first curl suppressing member 51 is positioned above the rear end area S1 of the mediums P mounted on the discharge tray 37.

When the first curl suppressing member 51 provided in the link mechanism 60 is moved in the return direction −R and is returned to the position illustrated in FIG. 16, the endless belt 73 is rotated clockwise in FIG. 16.

The guide pin 82 provided in the cam members 83 is guided by the second groove portion 81*b* and moves in the return direction −R. In the return direction −R, the second groove portion 81*b* merges with the first groove portion 81*a* and moves the link mechanism 60 in the return direction −R until the carriage portion 75 is detected by a position sensor 90. With the above, the first curl suppressing member 51 can be returned to the home position.

Note that reference numeral 90 is a position sensor that detects that the carriage portion 75, or the first curl suppressing member 51, is at the home position.

Figure 15:
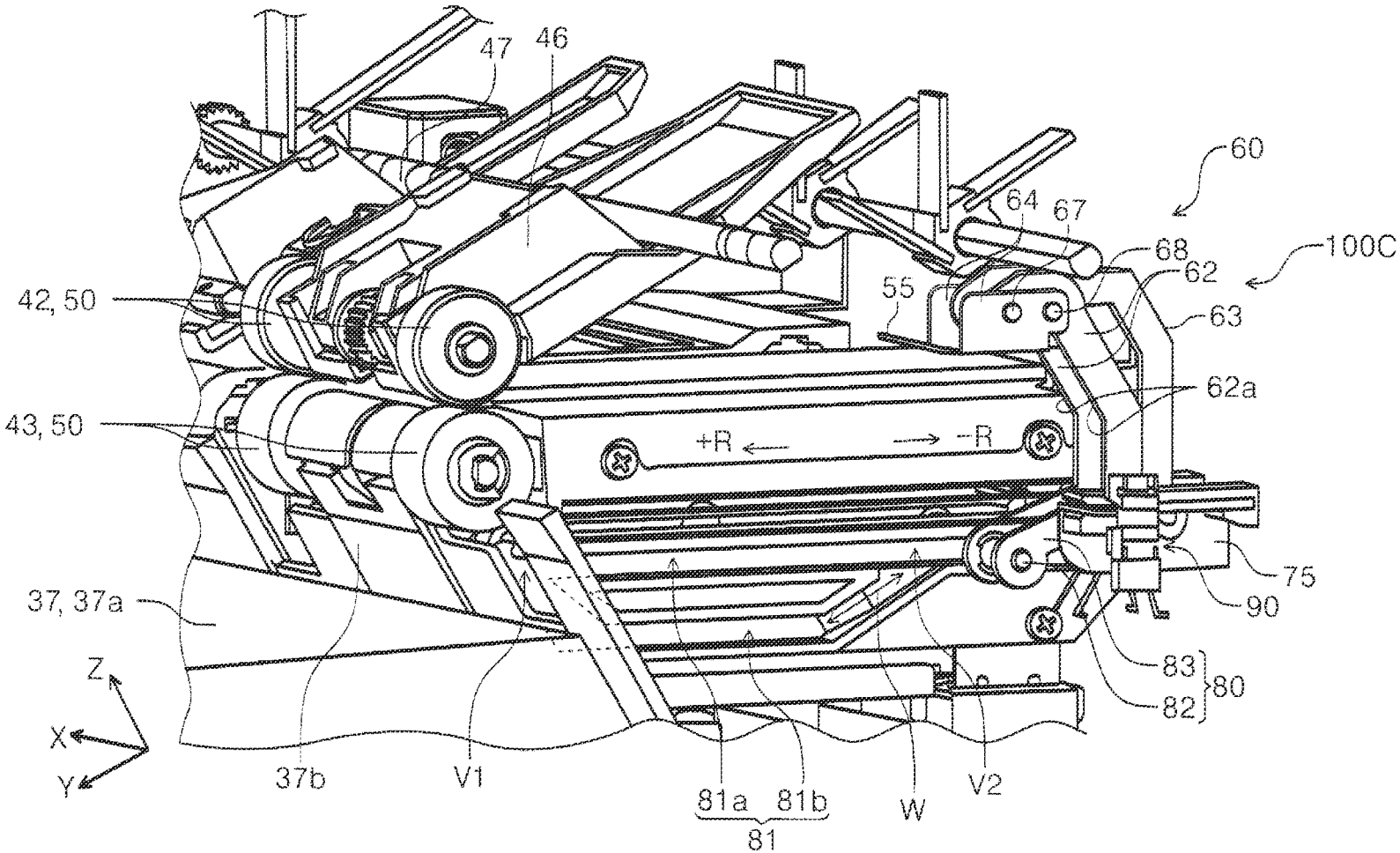
FIG. 15 is an enlarged perspective view of a portion around a first curl suppressing member.

Note that the area in the second groove portion 81*b* indicated by a reference sign W in FIG. 15 is formed shallower than the other areas. The area in the second groove portion 81*b* other than the area W is formed with the same depth as that of the first groove portion 81*a*. In other words, in a connection portion V1 and a connection portion V2 between the first groove portion 81*a* and the second groove portion 81*b* illustrated in FIG. 15, while there is no difference in the depth in the connection portion V1 on the discharge direction +R side, there is a difference in depth in the connection portion V2 on the return direction −R side and the first groove portion 81*a* is deeper.

The guide pin 82 is pressed in the +X direction with a coil spring 84 (see FIG. 11) so that the guide pin 55 is urged against the guide groove 81. Owing to the pressing force of the coil spring 84, the guide pin 82 moving through the second groove portion 81*b* in the return direction −R can be, in the connection portion V2, reliably returned to the deep first groove portion 81*a* from the shallow second groove portion 81*b*, and the guide pin 82 can be prevented from erroneously entering the second groove portion 81*b* at the connection portion V2 when the guide pin 82 moves through the first groove portion 81*a* in the discharge direction +R.

A configuration in which the first curl suppressing member 51 can maintain a predetermined position when moving in the discharge direction can be obtained with the link mechanism 60 and the cam mechanism 80 described above.

Second aligning surfaces 62*a* are formed in the second arm portions 62 constituting the link mechanism 60 described above. As illustrated in FIG. 17, when the first curl suppressing member 51 is at the home position, the second arm portions 62 are positioned on the discharge direction +R side with respect to the first aligning surface 38*a* of the first rear end aligning portion 38. Accordingly, when the first curl suppressing member 51 is at the home position, the rear ends E1 of the mediums P are not aligned by the first aligning surface 38*a* but are aligned by the second aligning surfaces 62*a*.

Similar to the second aligning surface 104*a* that has been described with reference to FIG. 7, an angle formed between each second aligning surface 62*a* and the wall surface 37*b* is smaller than the angle α formed between the wall surface 37*b* and the first aligning surface 38*a*; accordingly, by aligning the rear ends E1 of the mediums P with the second aligning surfaces 62*a*, the mediums P discharged on the discharge tray 37 can be prevented from being loaded in a stepwisely displaced manner. As a result, the usability for the user is improved and damage can be suppressed from occurring at the rear ends E1 of the mediums P.

Note that in the present exemplary embodiment, the angle formed between each second aligning surface 62*a* and the wall surface 37*b* is 0°. With the above, the mediums P discharged on the discharge tray 37 can be prevented from being loaded in a stepwisely displaced manner.

Figure 21:
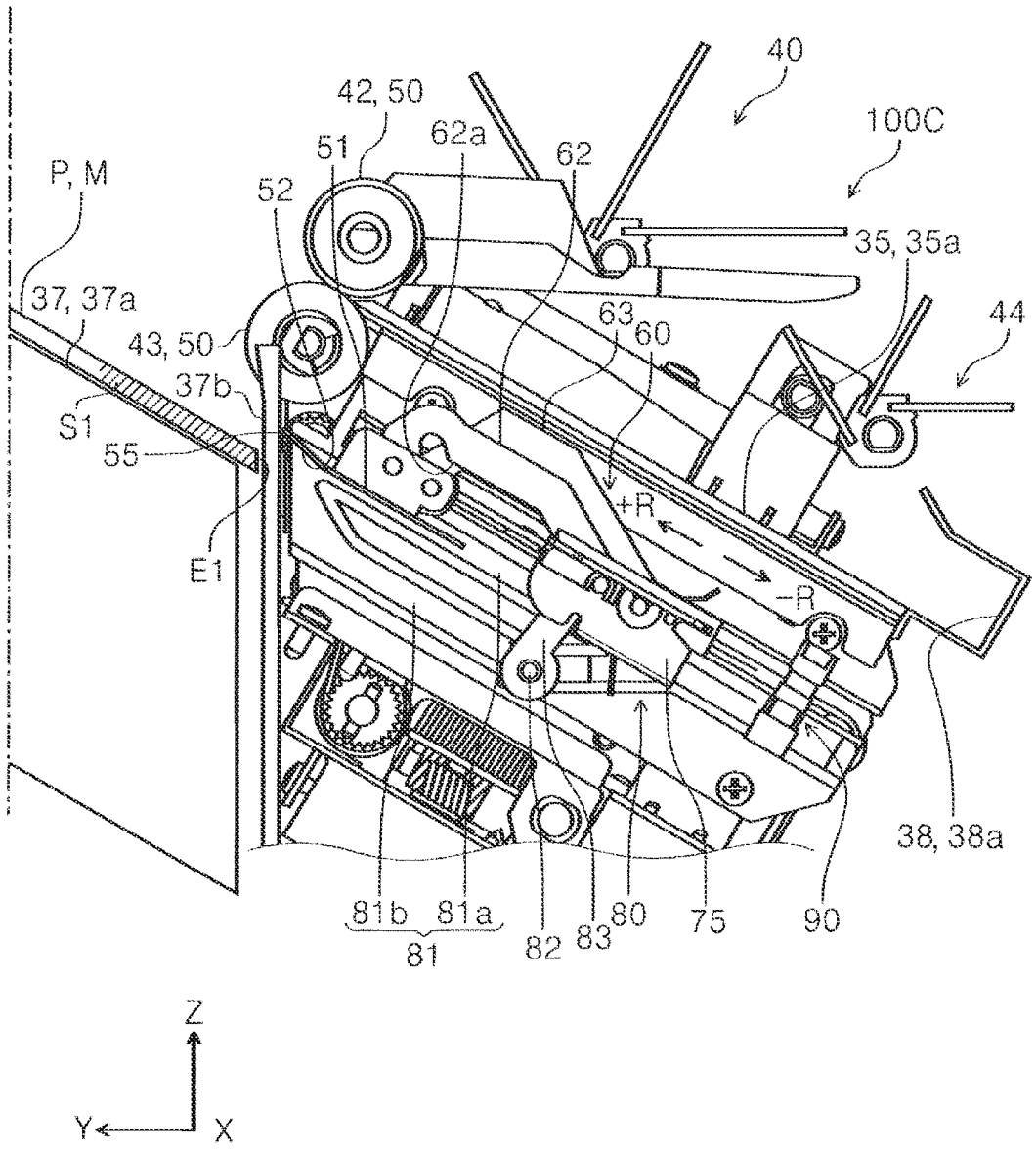
FIG. 21 is a side view of the medium aligning apparatus according to the third exemplary embodiment.

Note that in the present exemplary embodiment, when the rear ends E1 of the mediums P are aligned using the first aligning surface 38*a*, the link mechanism 60 is held at the position illustrated in FIG. 21. Since the link mechanism 60 does not protrude above the load tray 35 in the above state, the mediums P discharged on the load tray 35 do not come in contact with the link mechanism 60 and the rear ends E1 of the mediums P are aligned by the first aligning surface 38*a*.

Note that when the stack M of mediums P is discharged on the discharge tray 37 from the load tray 35, the upper rollers 42 constituting the discharge member 50 are first lowered from the state illustrated in FIG. 17, and the stack M of mediums P is nipped between the upper rollers 42 and the lower rollers 43. Subsequently, the operation of discharging the stack M of mediums P performed by the rollers and the operation of moving the link mechanism 60 in the discharge direction +R are performed at the same time. In so doing, control is executed so that the operation of discharging the mediums P is basically performed by the discharge member 50 and so that the second aligning surfaces 62*a* following the rear ends E1 of the mediums P move in the discharge direction +R. However, since the upper rollers 42 are driven rollers, the discharge of the mediums P of the stack M of mediums P on the upper side may lag behind the mediums P of the stack M of mediums P on the lower side. However, in such a case, since the rear ends E1 are urged against the second aligning surfaces 62*a*, the aligned state of the rear ends E1 is not disturbed so much and the stack M of mediums P are appropriately moved in the discharge direction.

The present disclosure is not limited to the exemplary embodiments described above and may be modified in various ways that are within the scope of the claims. It goes without saying that the modifications are also included in the scope of the present disclosure.

What is claimed is:

1. A medium aligning apparatus comprising:

a load tray on which a medium to be discharged by a discharge member that discharges a medium is loaded;

a rear end aligning surface that performs aligning of a plurality of mediums loaded on the load tray by positioning rear ends of the mediums, the rear ends being upstream ends of the mediums in a direction in which the mediums are discharged with the discharge member; and a wall surface in a discharge tray that receives the medium discharged from the load tray, wherein the rear ends of the mediums come in contact with the wall surface, wherein the wall surface and the rear end aligning surface are parallel to each other, and the plurality of mediums aligned using the rear end aligning surface are discharged to the discharge tray while the rear ends of the mediums are moved by the rear end aligning surface.

2. The medium aligning apparatus according to claim 1, wherein a load surface of the load tray and a support surface of the discharge tray that supports the medium are inclined upwards towards a downstream side in a discharge direction.

3. The medium aligning apparatus according to claim 1, wherein when, at least, a process is not to be performed on the mediums loaded on the load tray, the rear ends of the mediums are aligned using the rear end aligning surface.

4. The medium aligning apparatus according to claim 1, wherein the plurality of mediums are discharged without changing an alignment performed by the rear end aligning surface.

5. A medium processing apparatus comprising:

medium aligning apparatuses according to claim 1; and a processing portion that is, with respect to the load tray, positioned upstream in a direction in which the medium is discharged by the discharge member, the processing portion performing a process on the medium loaded on the load tray.

6. A recording system comprising:

a recording unit that includes a recording member that performs recording on a medium; and a medium processing apparatus according to claim 5, wherein the medium processing apparatus performs a process on a recorded medium recorded in the recording unit.

7. The medium aligning apparatus according to claim 1, wherein a load surface of the load tray and a support surface of the discharge tray that supports a medium are parallel to each other.

8. The medium aligning apparatus according to claim 1, wherein a first aligning surface and a second aligning surface are disposed on both sides of a center position of a medium processing apparatus in a width direction that is a direction intersecting a discharge direction of a medium.

9. A medium aligning apparatus comprising:

a load tray on which a medium to be discharged by a discharge member that discharges a medium is loaded;

a rear end aligning surface that performs aligning of a plurality of mediums loaded on the load tray by positioning rear ends of the mediums, the rear ends being upstream ends of the mediums in a direction in which the mediums are discharged with the discharge member; and a wall surface in a discharge tray that receives the medium discharged from the load tray, wherein the rear ends of the mediums come in contact with the wall surface, wherein the wall surface and the rear end aligning surface are parallel to each other, and the plurality of mediums are discharged without changing an alignment performed by the rear end aligning surface until discharged to the discharge tray while the rear ends of the mediums are moved by the rear aligning surface.

* * * * *